US010667600B2

(12) United States Patent
Ji et al.

(10) Patent No.: US 10,667,600 B2
(45) Date of Patent: Jun. 2, 2020

(54) DIAPER BAG BACKPACK

(71) Applicant: Vianetic LLC, Stamford, CT (US)

(72) Inventors: Taoli Ji, Stamford, CT (US); Sobonneth Ung, Stamford, CT (US)

(73) Assignee: Vianetic, LLC, Trumbull, CT (US)

( * ) Notice: Subject to any disclaimer, the term of this patent is extended or adjusted under 35 U.S.C. 154(b) by 0 days.

(21) Appl. No.: 16/126,392

(22) Filed: Sep. 10, 2018

(65) Prior Publication Data

US 2019/0082817 A1 Mar. 21, 2019

Related U.S. Application Data

(60) Provisional application No. 62/561,466, filed on Sep. 21, 2017.

(51) Int. Cl.

| | |
|---|---|
| ***A45F 3/04*** | (2006.01) |
| ***A47D 5/00*** | (2006.01) |
| ***A45C 7/00*** | (2006.01) |
| ***A45F 4/02*** | (2006.01) |
| ***A45C 15/00*** | (2006.01) |

(52) U.S. Cl.

CPC ..... *A45F 4/02* (2013.01); *A45C 15/00* (2013.01); *A45F 3/04* (2013.01); *A47D 5/006* (2013.01); *A45C 2007/0004* (2013.01)

(58) Field of Classification Search

CPC ..... A45F 4/06; A45F 2004/026; A45F 4/02; A45C 9/00; A45C 7/0095; A47D 5/006

See application file for complete search history.

(56) References Cited

U.S. PATENT DOCUMENTS

| | | | | |
|---|---|---|---|---|
| 1,116,874 A | | 7/1871 | Schaefer | |
| 4,466,516 A | * | 8/1984 | Sicoli | A47G 9/062 190/2 |
| 4,468,810 A | * | 8/1984 | Longo | A45F 4/06 190/1 |
| 4,810,102 A | * | 3/1989 | Norton | A45C 1/04 150/108 |
| 4,917,505 A | * | 4/1990 | Bullard | A45C 9/00 190/1 |
| 4,984,906 A | * | 1/1991 | Little | A45C 9/00 190/107 |
| 5,165,111 A | * | 11/1992 | Lieberman | A41D 15/04 2/108 |
| 5,199,120 A | * | 4/1993 | Holmes | A45F 4/06 190/2 |

(Continued)

OTHER PUBLICATIONS

International Search Report and Written Opinion dated Jan. 28, 2019, for corresponding International Application No. PCT/US2018/050213.

*Primary Examiner* — Brian D Nash

(74) *Attorney, Agent, or Firm* — Athorus, PLLC

(57) ABSTRACT

A backpack comprising a first lateral wall including at least one fastener disposed along a first peripheral front edge, a second lateral wall including at least one further fastener disposed along a second peripheral front edge, and a front flap pivotably movable between a closed position and an open position and having at least one third fastener disposed along at least a portion of a perimeter of the front flap, the at least one third fastener releasably engaging the at least one fastener and the at least one further fastener when the front flap is in a closed position.

20 Claims, 21 Drawing Sheets

(56) References Cited

U.S. PATENT DOCUMENTS 5,230,450 A * 7/1993 Mahvi ..... A45C 7/0045 190/108
5,562,204 A * 10/1996 Sapyta ..... A45C 7/0054 190/110
5,564,125 A * 10/1996 Waldman ..... A41D 3/00 2/93
5,573,166 A 11/1996 Leja
5,611,457 A * 3/1997 Ash, Jr. ..... A45F 3/04 221/185
5,649,658 A * 7/1997 Hoffman ..... A45F 3/04 190/2
5,657,917 A * 8/1997 Johnson ..... A45F 3/04 224/153
5,673,836 A * 10/1997 Bush ..... A41D 13/00 2/94
5,785,219 A * 7/1998 Kraft ..... A45F 4/02 2/66
D409,376 S 5/1999 Golenz et al.
6,095,389 A 8/2000 Fenton et al.
6,223,367 B1 * 5/2001 French ..... A45C 3/10 383/4
6,243,892 B1 * 6/2001 Kelling ..... A45F 4/06 224/153
6,298,993 B1 * 10/2001 Kalozdi ..... A45C 3/00 150/106
D457,307 S 5/2002 Pukall et al.
6,493,891 B1 * 12/2002 Livingston ..... A45C 3/10 150/110
D506,607 S 6/2005 Fonfeder
D510,660 S 10/2005 Suppancig
7,225,483 B1 * 6/2007 Remblad ..... A45F 4/06 383/4
7,350,252 B2 4/2008 Telegadis et al.
7,374,071 B2 * 5/2008 Lavelle ..... A41D 3/08 2/94
7,735,170 B1 6/2010 Emerson
7,761,944 B2 * 7/2010 Skophammer ..... A45C 9/00 190/1
7,797,774 B1 * 9/2010 Beyert ..... A45C 9/00 5/417
D641,973 S 7/2011 Quehl
7,971,764 B2 7/2011 Sabbah
8,001,803 B2 8/2011 Kanagaki
8,061,547 B2 * 11/2011 Camp, Jr. ..... A45C 11/20 220/507
8,151,389 B1 * 4/2012 Lando ..... A47D 5/006 5/655
D674,183 S 1/2013 Iacchetti
8,490,230 B2 7/2013 Rovin
8,578,526 B1 * 11/2013 Rosso ..... A47C 1/146 5/417
D699,944 S 2/2014 Mather
D713,139 S 9/2014 Ford
9,144,290 B1 * 9/2015 Hall ..... A45F 4/00
9,771,183 B1 * 9/2017 Oliver ..... A45C 3/00
D836,326 S 12/2018 Skaff
D860,639 S 9/2019 Thibadeau
2002/0084197 A1 * 7/2002 Carbonneau ..... A45C 3/10 206/216
2003/0024960 A1 * 2/2003 Greenstein ..... A45C 11/20 224/153
2003/0042277 A1 * 3/2003 Gulmatico, III ..... A45C 7/0077 224/153
2003/0205593 A1 * 11/2003 Lavelle ..... A41D 3/08 224/153
2004/0155077 A1 * 8/2004 Cullen ..... A45C 3/10 224/153
2005/0236002 A1 * 10/2005 Cooley ..... A47D 5/00 128/845
2006/0032881 A1 2/2006 Price et al.
2006/0090975 A1 * 5/2006 Brock ..... A45C 15/00 190/2
2006/0105137 A1 * 5/2006 Kouts ..... A45C 7/0095 428/99
2006/0283205 A1 * 12/2006 Carriere ..... A45C 13/02 62/457.2
2007/0113338 A1 * 5/2007 Remblad ..... A45F 4/06 5/420
2007/0187444 A1 * 8/2007 Hajari ..... A01M 31/02 224/155
2007/0214613 A1 9/2007 Shiao
2008/0054032 A1 * 3/2008 Jones ..... A45F 4/06 224/156
2009/0184143 A1 * 7/2009 Witt ..... A45C 7/0059 224/153
2010/0032459 A1 * 2/2010 Clark ..... A45F 4/06 224/154
2010/0059558 A1 * 3/2010 Robinson ..... A41D 3/08 224/155
2011/0127815 A1 * 6/2011 Nickerson ..... A45F 4/02 297/217.1
2011/0240703 A1 * 10/2011 Tobin ..... A45F 3/16 224/576
2011/0314608 A1 * 12/2011 Rovin ..... A47D 5/006 5/655
2012/0031935 A1 * 2/2012 Cook ..... A45C 15/00 224/153
2012/0103480 A1 5/2012 Veleno et al.
2013/0001262 A1 * 1/2013 Razavi ..... A45F 4/02 224/156
2013/0015217 A1 * 1/2013 Perez ..... A45F 4/06 224/156
2013/0277407 A1 10/2013 Murdoch et al.
2013/0287905 A1 * 10/2013 Loisel ..... B65D 47/06 426/115
2014/0091007 A1 4/2014 Garside
2015/0076182 A1 * 3/2015 Coleman ..... A45F 3/04 224/155
2015/0083764 A1 3/2015 Houston et al.
2016/0242519 A1 * 8/2016 Calman ..... B25H 3/023
2017/0000243 A1 * 1/2017 Seuk ..... A45F 4/02
2018/0110318 A1 * 4/2018 Ackerman ..... A45F 3/04
2018/0206650 A1 * 7/2018 Kong ..... A47D 5/006
2019/0178571 A1 * 6/2019 Kelly ..... F25D 31/007

* cited by examiner

DIAPER BAG BACKPACK

CROSS REFERENCE TO RELATED APPLICATIONS

This application claims the benefit of U.S. Provisional Patent Application Ser. No. 62/561,466, filed Sep. 21, 2017, which is hereby incorporated by reference in its entirety.

FIELD

Embodiments of the present invention relate generally to backpacks and diaper bags. Specifically, embodiments of the present invention relate to a diaper bag backpack.

BACKGROUND

Changing a baby on the go can be a challenging task, especially while away from home. Generally, parents or caregivers may try to find a baby changing station. Baby changing stations typically offer a convenient surface on which a baby can be placed for changing a diaper. Otherwise, changing a diaper in a car or on the ground can be difficult, inconvenient, and/or unhygienic. Additionally, positioning of a diaper bag can be difficult and, due to the angled configuration of many car seats, the positioning of the baby may not be optimal. Further, feces and/or urine could potentially spill onto the car seat. Placing the baby on a ground surface can also be uncomfortable for the baby and inconvenient to the parent or caregiver, as the parent or caregiver usually has to kneel down to change the baby's diaper. Furthermore, current diaper bags do not provide an easy-to-access mechanism that allow quick, easy access to almost all contents in the bag at once.

SUMMARY

Embodiments of the present invention can provide a backpack. The backpack can include a first lateral wall including at least one fastener disposed along a first peripheral front edge, a second lateral wall including at least one further fastener disposed along a second peripheral front edge, and a front flap pivotably movable between a closed position and an open position and having at least one third fastener disposed along at least a portion of a perimeter of the front flap. The at least one third fastener can releasably engage the at least one fastener and the at least one further fastener when the front flap is in a closed position.

According to embodiments of the present invention, the front flap can be designed and dimensioned to constitute substantially an entire front portion of the backpack such that an internal compartment defined by the first and second lateral walls can be substantially entirely accessible when the front flap is in the open position.

According to certain exemplary embodiments, the backpack can include a back wall including a top fastener disposed along a peripheral top edge extending from the back wall and a second top fastener disposed along a top portion of the perimeter of the front flap. The second top fastener can releasably engage the top fastener when the front flap is in a closed position. According to certain exemplary embodiments, the second top fastener can disengage the top fastener upon the application of a first force and a second force, a direction of the first force and a direction of the second force disposed in separate planes.

According to certain exemplary embodiments, the backpack can include a diaper pad removably coupled to an interior surface of the front flap. According to certain exemplary embodiments, the diaper pad can be removably coupled to a track attached to the interior surface of the front flap, the track can include a loop that can slidably engage a second loop disposed on the diaper pad. According to certain exemplary embodiments, the diaper pad can be folded.

According to certain exemplary embodiments, the backpack can include a beverage pack which can have a profile configured to be removably stored within the backpack and can be designed and dimensioned to store at least one of a standard size wine bottle, baby bottle(s), or three or more baby food containers.

According to certain exemplary embodiments, the at least one fastener, the at least one further fastener, and the at least one third fastener can include magnetic fasteners. According to certain exemplary embodiments, the backpack can include support structures which can be configured to enable backpack to stay upright when placed on a surface.

According to certain exemplary embodiments, in the closed position, the releasable engagement of the at least one third fastener with the at least one fastener and the at least one further fastener can substantially seal the front flap and the first and second peripheral edges of the first and second lateral walls.

Embodiments of the present invention can provide a backpack. The backpack can include a multi-function strap including a first member and a second member. A first end of the first member can be movably coupled to a first shoulder strap and a second end of the first member can have a first fastener disposed thereon and a first end of the second member can be movably coupled to a second shoulder strap and a second end of the second member can have a second fastener disposed thereon. The first and second fasteners can be couplable to each other and couplable to third and fourth fasteners disposed on the first and second shoulder straps, respectively.

According to certain exemplary embodiments, the first fastener can couple to the second fastener to form a sternum strap which can secure the first and second shoulder straps relative to one another.

According to certain exemplary embodiments, the first fastener can couple to the third fastener to form a securing loop and the second fastener can couple to the fourth fastener to form a further securing loop. The securing loop and the further securing loop can permit the backpack to be secured to a structure by having at least a portion of the structure pass through the securing loop and the further securing loop.

According to certain exemplary embodiments, the first fastener can couple to the second fastener to form a third securing loop, the third securing loop permitting the backpack to be secured to a structure by having at least a portion of the structure pass through the third securing loop.

According to certain exemplary embodiments, the first shoulder strap can include a first pocket and the second shoulder strap can include a second pocket, the first pocket can be configured to store the first member and the second pocket can be configured to store the second member.

According to certain exemplary embodiments, the backpack can include a front flap pivotably movable between a closed position and an open position and which can have at least one fastener disposed along at least a portion of a perimeter of the front flap. The at least one fastener can be configured to releasably engage at least one second fastener disposed along a first peripheral front edge of a first lateral wall and at least one third fastener disposed along a second peripheral front edge of a second lateral wall.

DETAILED DESCRIPTION

Embodiments of the present invention generally relate to a backpack, and more specifically to a diaper bag backpack. Specifically, certain exemplary embodiments of the present invention can provide a diaper bag backpack with various new and novel features that allow, for example, quick and easy operation to change the bag into a diaper changing station and provide unfettered access to the contents of the bag, while allowing the bag to be conveniently oriented and/or positioned.

Figure 1A:
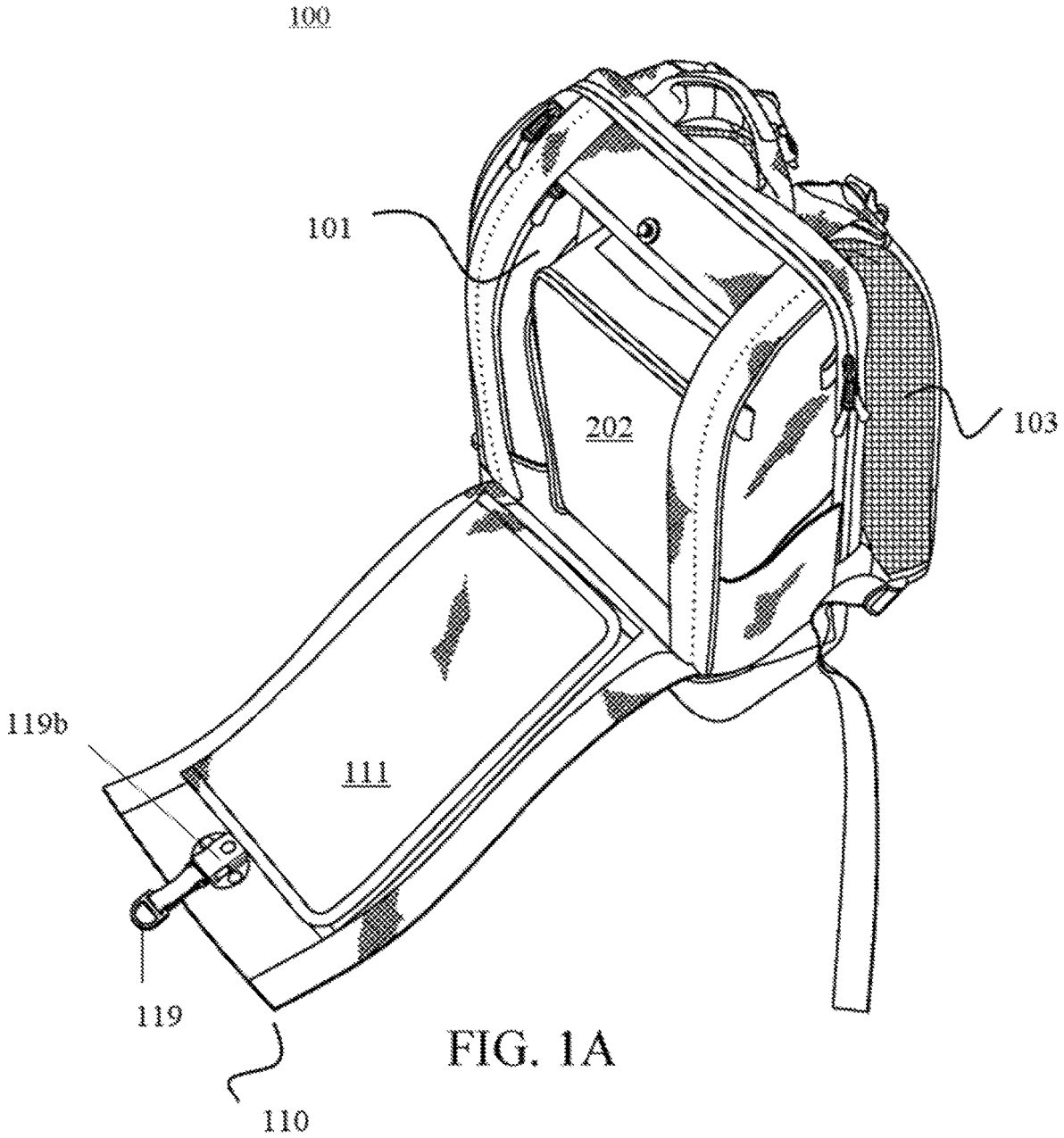
FIGS. 1A-C are front perspective views of an exemplary backpack according to an embodiment of the present invention.
Figure 1B:
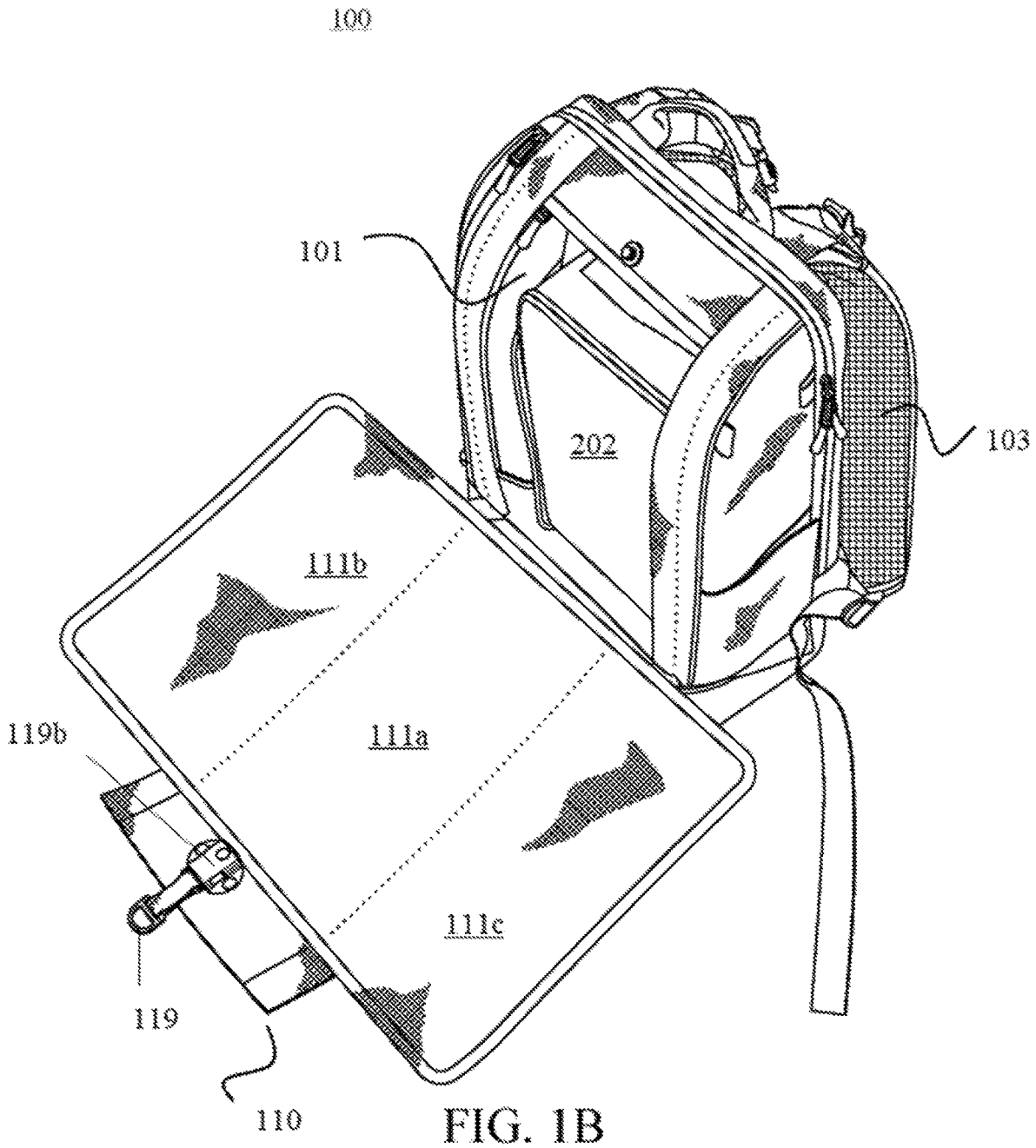
Figure 1C:
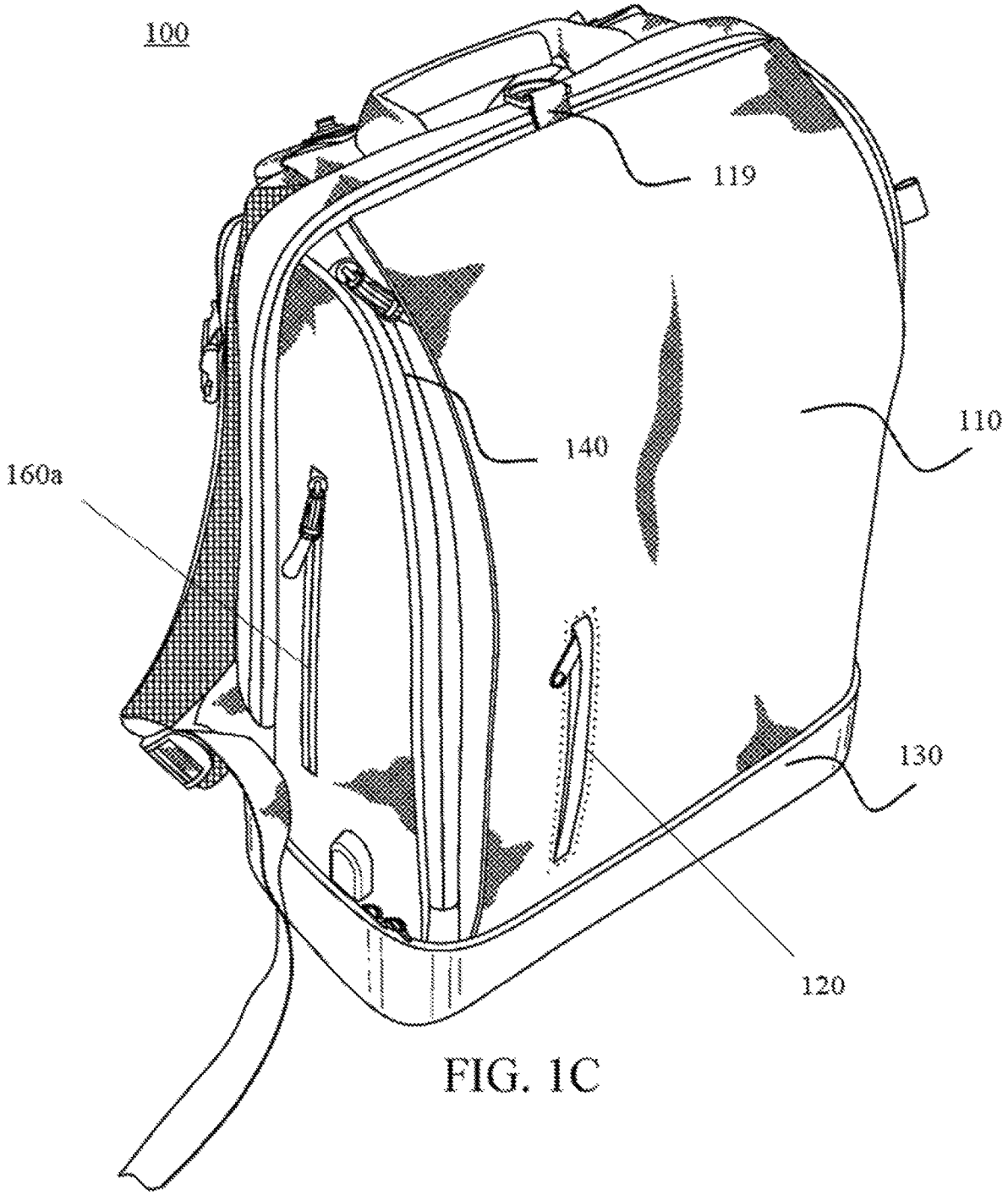
Figure 2:
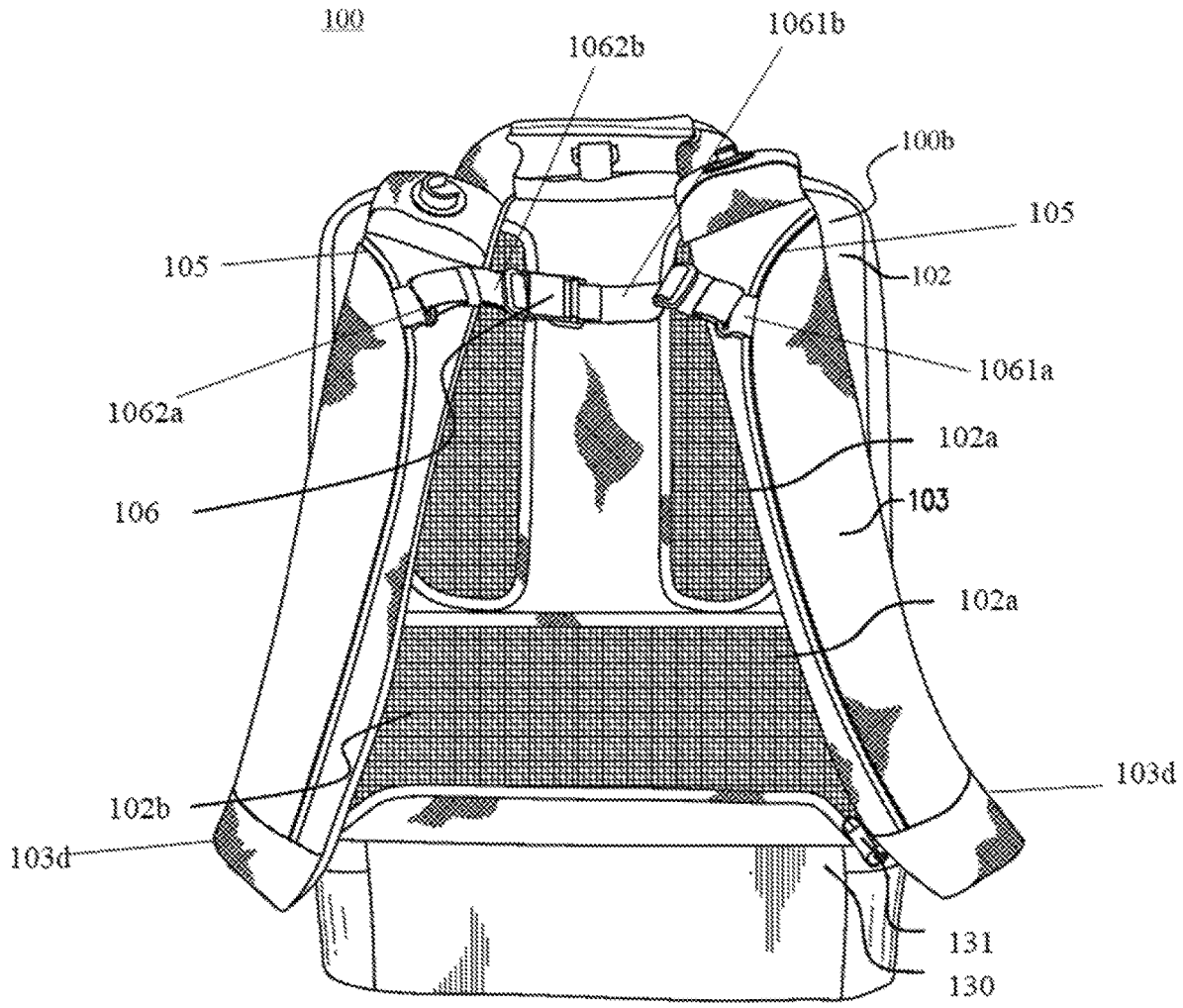
FIG. 2 is a back view of an exemplary backpack according to an embodiment of the present invention.

An embodiment of present invention can provide a diaper bag backpack. The exemplary diaper backpack can be easy to open with a single-handed operation in preparation perform a diaper change and to provide easy access to substantially all the contents within the bag, while avoiding having a deep pocket where the bag's contents are difficult to see, find, and access FIGS. 1-11D show an exemplary backpack 100 in accordance with embodiments of the present invention. As shown in FIGS. 1-11D, backpack 100 can include front side 100*a*, back side 100*b*, first lateral side 100*c* and second lateral side 100*d*. Backpack 100 may include a plurality of internal compartments for storage of items. For example, as shown in FIGS. 1A-B and 5A-B, front side 100*a*, back side 100*b*, first lateral side 100*c* and second lateral side 100*d* may define main internal compartment 101, second internal compartment 130, and third internal compartment 150. Backpack 100 may additionally include a plurality of external pockets for storage of small items. For example, as shown in FIGS. 1C and 2, backpack 100 may include inner pockets 120 and 107. Backpack 100 may include one or more beverage holders 160 to enable a user to store one or more beverage containers. Backpack 100 can also include any variety and combination of pockets in various shapes to store virtually any item.

Figure 5A:
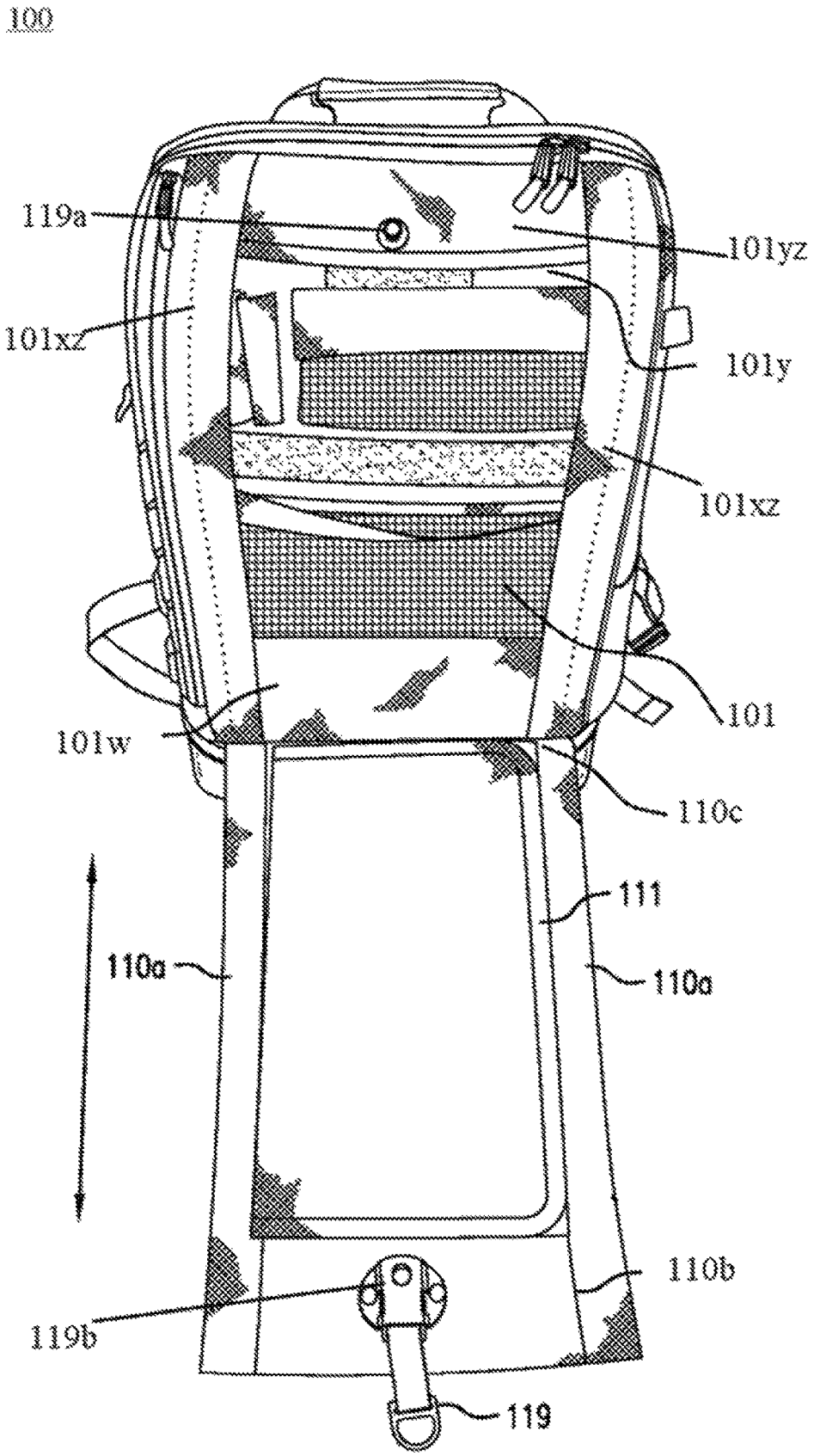
FIGS. 5A-C are front views of an exemplary backpack according to an embodiment of the present invention.
Figure 5B:
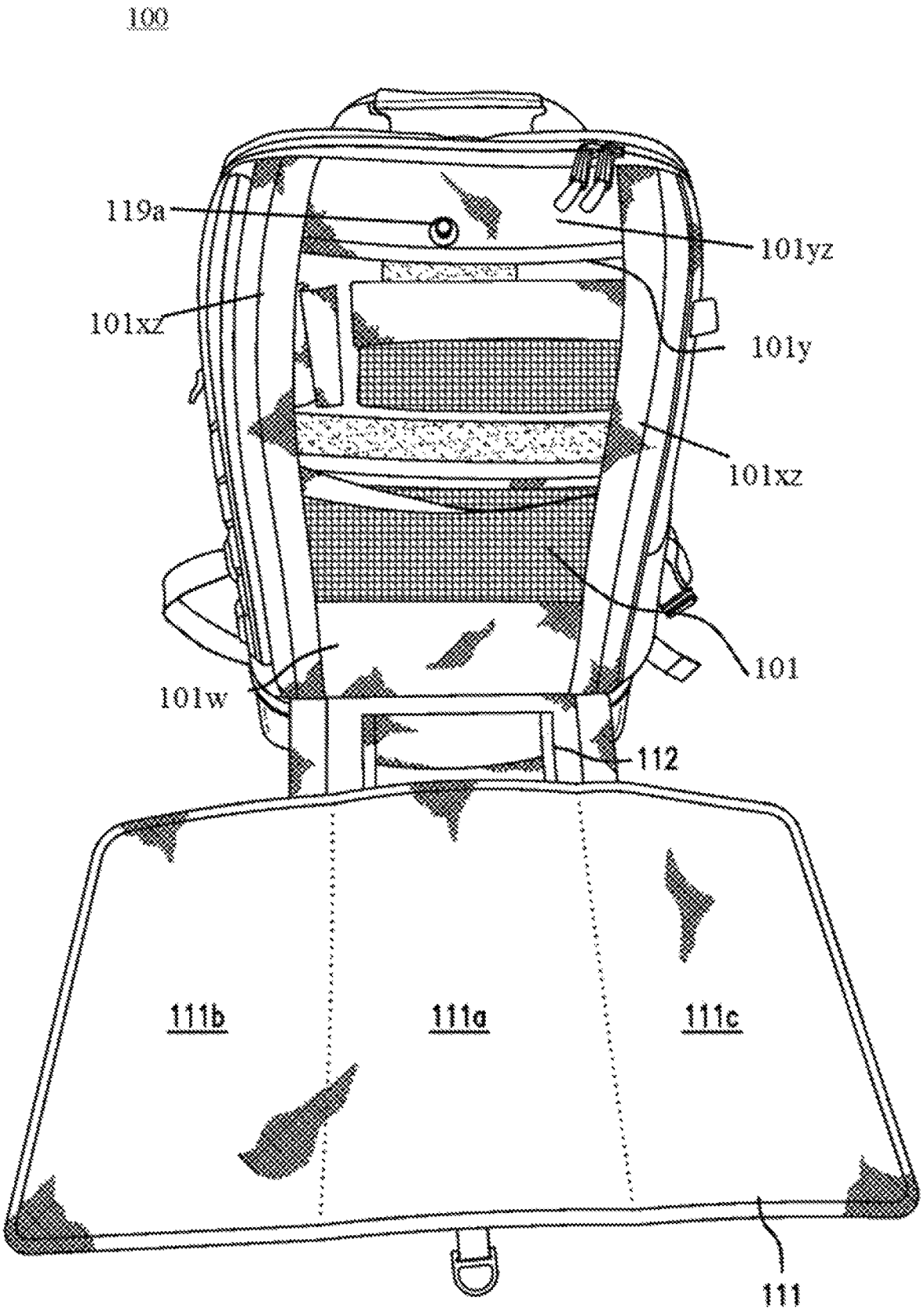

As can be seen in FIGS. 5A-B, main internal compartment 101 can be accessed via a front flap 110, which can allow the user to easily access the contents stored inside main internal compartment 101 of backpack 100. As can be seen in FIG. 1C, front flap 110 can include an external pocket 120 on outside surface 110*a* of front flap 110. Pocket 120 can be used for the storage of small items such as, for example, a passport, cellphone, wallet, credit cards, cash, etc. Pocket 120 can include a fastener, zipper, snap-button closures, or any other mechanism to seal pocket 120. According to certain exemplary embodiments, fasteners may be substantially waterproof or water resistant. Front flap 110 can also include a body with dimensions and a design matching the dimensions and overall design of front side 101 of backpack 100 and can be designed and dimensioned to substantially constitute the front side 101 of backpack 100. Front flap 110 can include a plurality of edges 110*a*, 110*b*, and 110*c* along a perimeter of front flap 110. Edges 110*a*, 110*b*, or 110*c* may comprise a plurality of fasteners 1012 (not shown). Fasteners 1012 can be any kind of fasteners configured to seal a compartment, such as, for example, zippers, magnetic closures, button closures, g-hooks, hook and loop mechanisms, etc. Front flap 110 can additionally include a release mechanism 119 along one or more of the edges 110*a*, 110*b*, or 110*c*. Release mechanism 119 can include fasteners, locks, magnetic closures, snaps, etc. For example, in a preferred embodiment, release mechanism 119 can include a plurality of magnets 119*a* and a snaps 119*b* which releasably secure front flap 110 to peripheral front edge 101*yz* of back wall 101*y* of backpack 100.

As shown in FIGS. 5A-B, front flap 110 may be pivotally coupled to backpack 100 so that front flap 110 is movable between an open position and a closed position. As such, in the open position, front flap 110 can provide access to the entire main internal compartment 101. Conversely, in the closed position, plurality of fasteners 1012 (not shown) on edges 110*a*, 110*b*, or 110*c* of front flap 110 can engage with fasteners 1011 (not shown) on main internal compartment 101 to seal or close the entire main internal compartment 101. Furthermore, fasteners 1012 may be designed to be sufficiently strong to enable the front flap 110 to remain in the closed position despite any shifting around of the contents of main internal compartment 101. As a result, front flap 110 is designed to remain in the closed position while being transported by a user so as to contain the contents of main internal compartment 101. Advantageously, front flap 110 enables a user to transition from the open position to a closed position with one-handed operation quickly and easily allowing for significant ease of use. For example, to transition front flap 110 from the closed position to the open position, a user need not disengage individual fasteners 1012, but use one quick motion to pivot front flap 110 away from backpack 100. Furthermore, in an embodiment, a user may actuate snaps 119*b* to release front flap 110 from body 100*a* by the application of a force in two different directions. For example, a force in two directions can include a first force in the direction of the plane of release mechanism 119 to disengage magnets 119*a* and snaps 119*b*, and a second force away from the direction of the plane of release mechanism 110 so as to disengage front flap 110 from the peripheral front edges 101*yz* and 101*xz*.

As shown in FIGS. 5A-B, main internal compartment 101 can include lateral walls 101*x*, a back wall 101*y*, and a bottom 101*w*. According to certain exemplary embodiments, main internal compartment 101 can be designed and dimensioned to store a plurality of items needed to change the diaper of babies or other items needed to take care of babies. Lateral walls 101*x* can include peripheral front edges 101*xz* along the front perimeter of main internal compartment 101. Edges 101*xz* can include one or more fasteners 1011 along at least a portion of the edges 101*xz*. Fastener(s) 1011 (not shown) can be configured to releasably engage edges 101*xz* to fasteners disposed on a periphery of front flap 110 thereby allowing a user to engage or disengage the front flap 110 from the main internal compartment 101 of the diaper backpack 100. Fasteners 1011 can include fasteners, such as, for example, zippers, magnetic closures, button closures, etc. Additionally, back wall 101*y* can include a peripheral front edge 101*yz* extending from the back wall 101*y* towards the peripheral front edges 101*xz*. Peripheral front edges 101*yz* can additionally include one or more fasteners 1012 (not shown) along a portion of the edges 101*xz*. Fasteners 1011 can also be configured to releasable engage fastener 1012 disposed on front flap 110. Fastener 1012 can be any fastener, such as, for example, zippers, magnetic closures, button closures, etc. In an exemplary embodiment, fasteners 1011 can releasably engage fasteners 1012 disposed on the front edges 101*xz*. For example, when front flap is in the closed position, fasteners 1011 can engage with plurality of fasteners 1012 on edges 110*a*, 110*b*, or 110*c* of front flap 110 to seal or close the entire main internal compartment 101. Furthermore, fasteners 1011 may be designed to be sufficiently strong to enable the front flap 110 to remain in the closed position despite any shifting around of the contents of main internal compartment 101. As a result, front flap 110 is designed to remain in the closed position while being transported by a user so as to contain the contents of main internal compartment 101. Advantageously, a user may transition the front flap 110 from the open position to a closed position with one-handed operation quickly and easily allowing for significant ease of use. For example, to transition front flap 110 from the closed position to the open position, a user need not disengage individual fasteners 1011 or 1012, but can use one quick motion to pivot front flap 110 away from backpack 100.

Figure 5C:
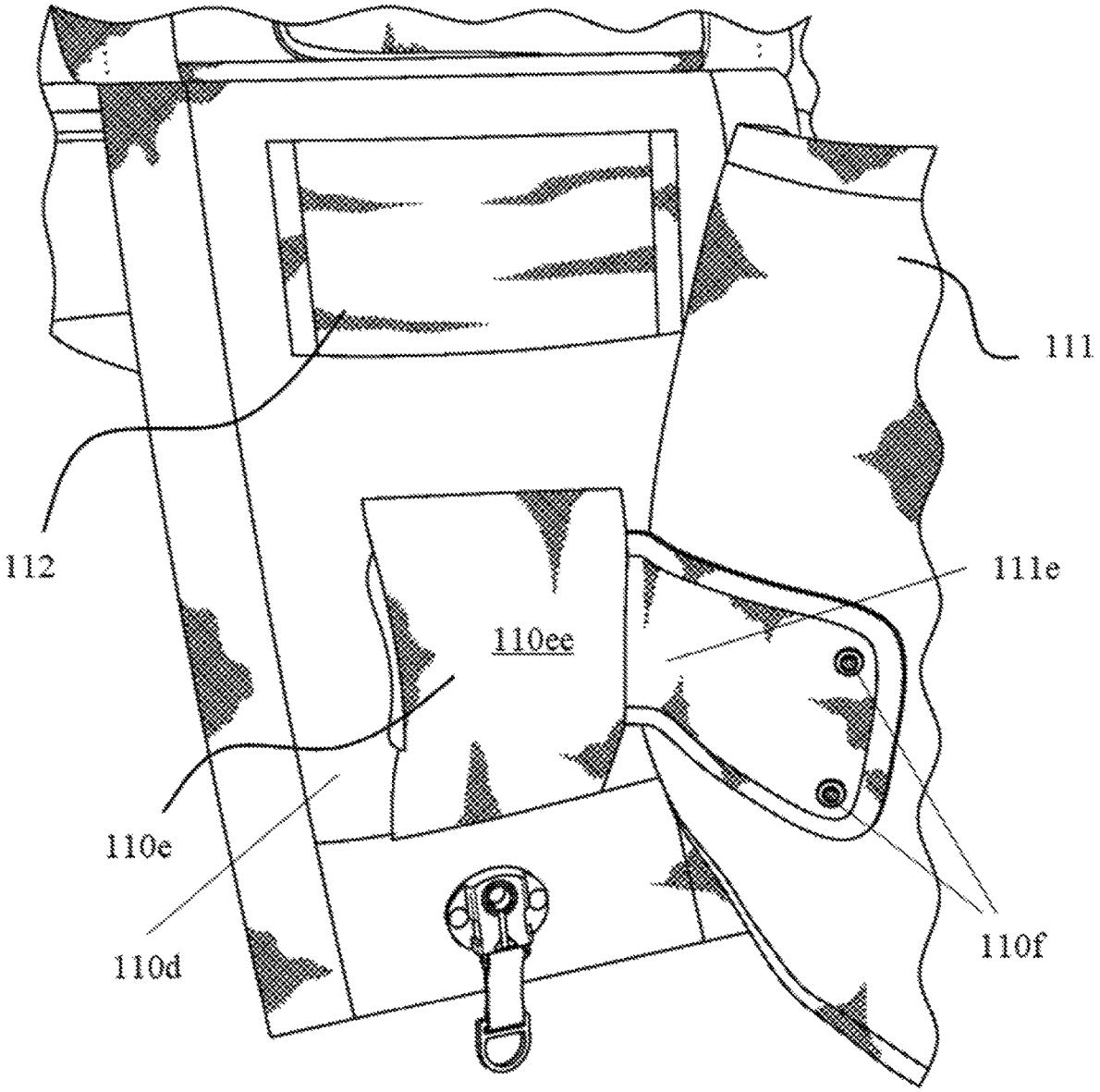
Figure 6:
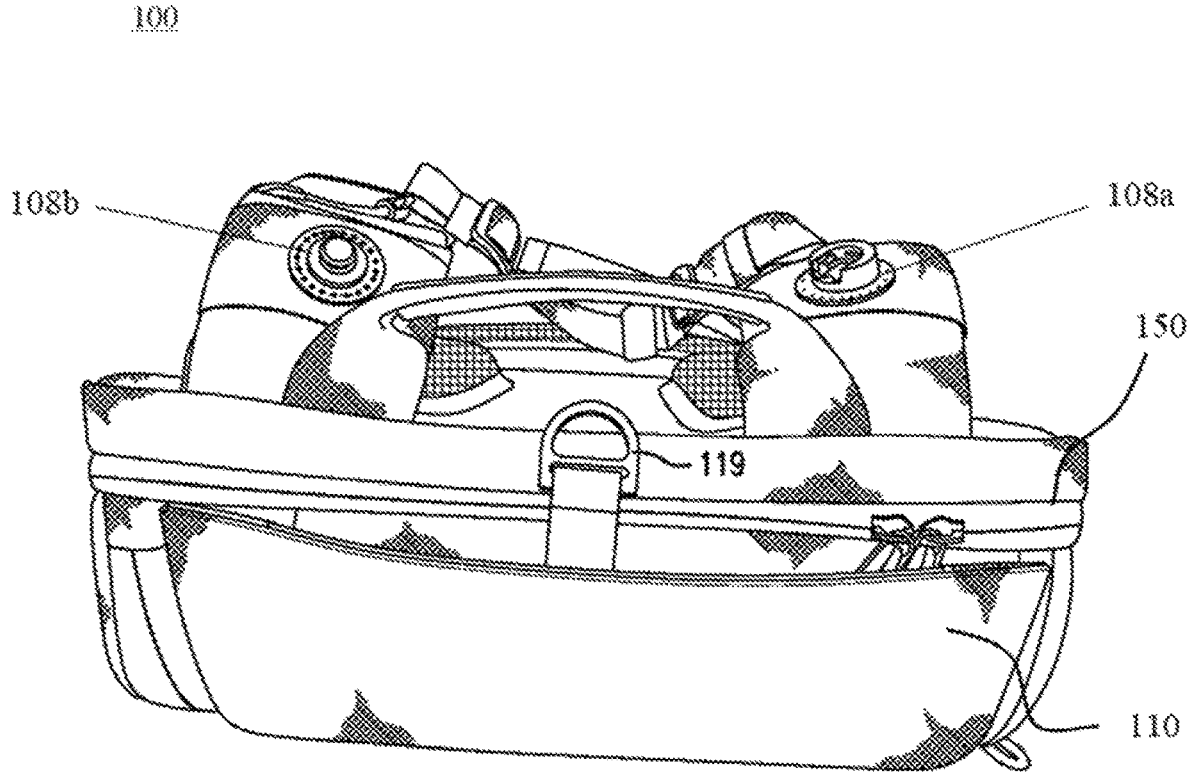
FIG. 6 is a top view of an exemplary backpack according to an embodiment of the present invention.

As can be seen in FIGS. 5A-C, inner surface 100*d* of front flap 110 may further include a diaper pad 111. As can be seen in FIG. 5C, pad 111 may be removably attached to a track 110*e* on inner surface 110*d*. For example, track 110*e* include a fabric loop 110*ee* affixed on the inner surface 110*d* of the front flap 110, and pad 111 can include a corresponding fabric loop 111*e* to engage with track 110*e*. Consequently, pad 111 can slide along track 110*e* and the length of front flap 110 so that pad 111 can be adjustably positioned along the length of inner surface 110*d* of the front flap 110. Also, loop 111*e* can include releasably coupling fasteners 110*f* that can allow pad 111 to be removed from track 110*e*, for example, to be cleaned or replaced. This may be preferably, for example, if a user, while changing the diaper of a baby, desires to adjust the distance of pad 111 along the length of front flap 110 and relative to backpack 100. Inner surface 110*d* can additionally include one or more pockets 112 to provide additional storage. Pockets 112 can include elastic means to provide compression such that items stored in pockets 112 may be securely stored.

In an embodiment of the present invention, as shown in FIG. 5B, pad 111 can be a deployable pad made from a plurality of sections 111*a*, 111*b*, and 111*c*. The plurality of sections 111*a-c* may comprise a flat, padded body interconnected to each other at a plurality of edges. The plurality of sections 111*a-c* may be folded on top of each other when closed and may be unfolded when open, as can be seen in FIG. 5B, and may be configured to fasten to each other using any type of fastener, such as hook and loop type fasteners or magnets. Folding pad 111 may be preferable for storage of pad 111 within main internal compartment 101 when front flap 110 is secured to backpack 100. Additionally, pad 111 may further comprise an additional plurality of components which allow the user to more comfortably and quickly change the diaper of a baby. In some embodiment of the present invention, edge 110*b* of front flap 110 may be detached from the front edge of the bottom of body 100*a* of diaper backpack 100. Edge 110*b* can further comprises a plurality of fasteners which allow the user to release front flap 110 from the body of diaper backpack 100 so front flap 110 can be separated from diaper backpack 100. In operation, once front flap 110 is in the open position, the user may deploy pad 111 as shown in FIG. 5B.

In operation, to use diaper pad 111, a user can first place backpack 100 on a substantially flat surface and open front flap 110 to access the contents of main internal compartment 101. Diaper backpack 100 maintains an upright position. The user moves the cover of the top and triggers release mechanism 119 on the top of diaper backpack 100. Front flap 110 is released and falls horizontally onto the surface. Once front flap 110 is in the open position, the user can then unfold pad 111 and slide pad 111 along the length of front flap 110 to optionally position pad 111 relative to backpack 100. For example, a user can slide pad 111 further away from backpack 100 in order to easily place a baby on pad 111 without the baby being able to reach contents of main internal compartment 101, or to allow for more room to change the baby's diaper. While the user changes the diaper of the baby, the user can easily and quickly reach the plurality of items stored inside the body of diaper backpack 100*a*. The configuration and operation of diaper pad 111 and the ease with which front flap 110 transitions from a closed position to an open position allows backpack 100 to be quickly and easily set up as a diaper changing station.

Figure 7A:
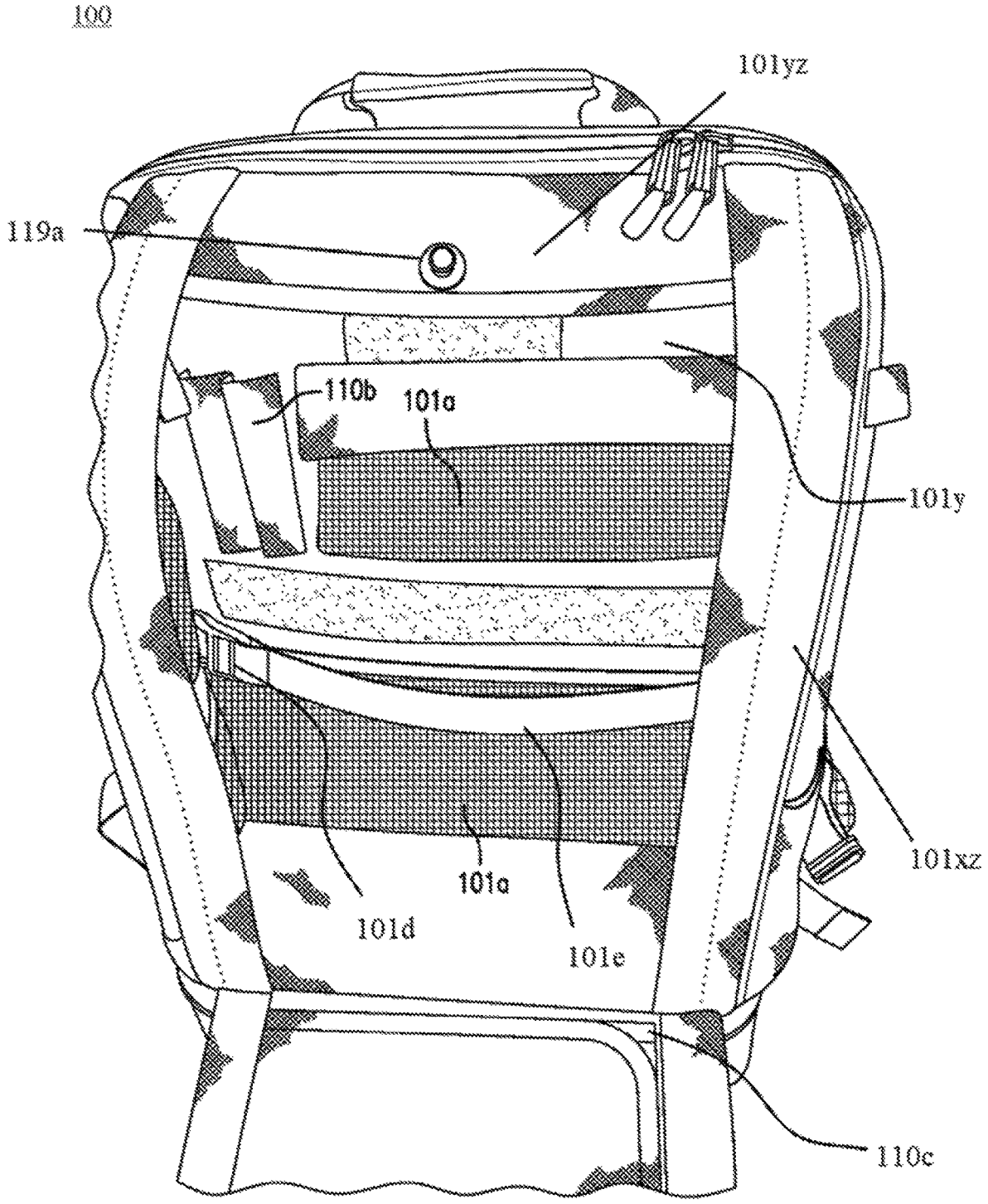
FIGS. 7A-B are close-up front views of an exemplary backpack according to an embodiment of the present invention.

In embodiments of the present invention, main internal compartment 101 can include any number and variety of pockets, straps, loops, hook and loop type fasteners, or any other means to facilitate storage of a variety of items. As shown in FIG. 7A, back wall 101*y* of main internal compartment 101 can include one or more mesh pockets 101*a*. Mesh pockets 101*a* may be closed using elastic fasteners, flaps, hook and loop type fasteners, or any other means designed to close pockets. Back wall 101*y* can additionally include holders 101*b*, designed to store writing utensils such as pens, pencils, highlighters, markers, etc. Additionally, as shown in FIG. 7A, back wall 101*y* can include webbing loops 101*c* on inside edges for attachment of hooks or loops. For example, webbing loops 101*c* (not shown) can be designed to receive hooks 101*d* affixed to compression strap 101*e*. Compression strap 101*e* can be used to secure storage items to a back wall of main internal compartment 101 so as to provide compression and prevent overpacking of main internal compartment 101.

Figure 7B:
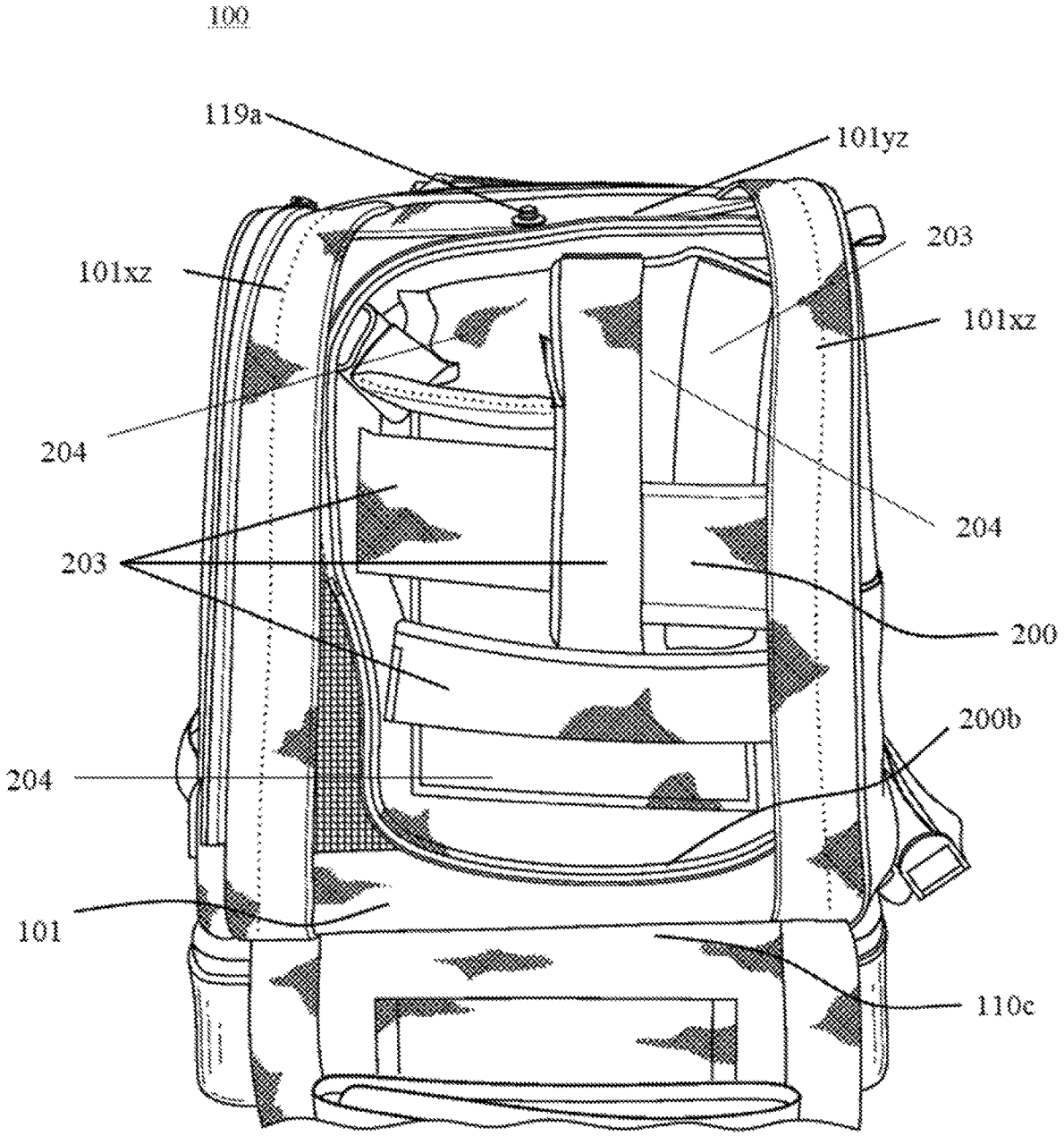

In a preferred embodiment, main internal compartment 101 may be configured to store a variety of items required to change a baby's diaper, including diaper wipes, diapers, diaper rash cream, etc. For example, as shown in FIG. 7B, main internal compartment 101 can include a caddy 200 to provide organized storage. Caddy 200 may be designed and dimensioned to fit within, and be removably affixed to, main internal compartment 101. For example, caddy 200 may include hook and loop type fasteners that can releasably engage hook and loop type fasteners in main internal compartment 101 so as to securely position caddy 200 in main internal compartment 101 in one or more orientations. In an embodiment, as shown in FIG. 7B, caddy 200 may be affixed in a vertical position in main internal compartment 101 using hook and loop type fasteners. In another embodiment, caddy 200 may be affixed in a horizontal position in main internal compartment 101 using hook and loop type fasteners. Caddy 200 may include webbing loops 201 (not shown) to allow a user to carry or hold caddy 200. Webbing loops 201 may be located on the one or more external surface(s) of caddy 200. Additionally, as shown in FIG. 1B, caddy 200 may include cover 202 to securely engage with and close caddy 200. For example, cover 202 may engage with caddy 200 using any type of fastener discussed herein, including a zipper, hook and loop type fasteners, snaps, magnets, etc. In a preferred embodiment, as can be seen in FIG. 7B, cover 202 can include a first track of a zipper 202*a* (not shown) along its perimeter to engage with a second track of zipper 202*b* on caddy 200 corresponding to the first track of zipper 202*a*. Cover 202 may be advantageous to secure and seal the contents of caddy 200. Caddy 200 can additionally include a variety of removable dividers 203. Removable dividers 203 may be configured in any combination and orientation in caddy 200 so as to enable a variety of configurations of storage slots 204. Storage slots 204 can be used to store a variety of items required to change a baby's diaper. Alternatively, storage slots 204 can be used to store a variety of other items such as camera equipment. For example, storage slots 204 may be configured to store one or more camera body(ies), camera lenses, rechargeable batteries, battery charger, etc. According to certain exemplary embodiments, caddy 200 can be integrally formed as part of main internal compartment 101. For example, caddy 200 may be formed by at least one of lateral walls 101*x*, back wall 101*y* and bottom wall 101*w* of main internal compartment 101.

Figure 3A:
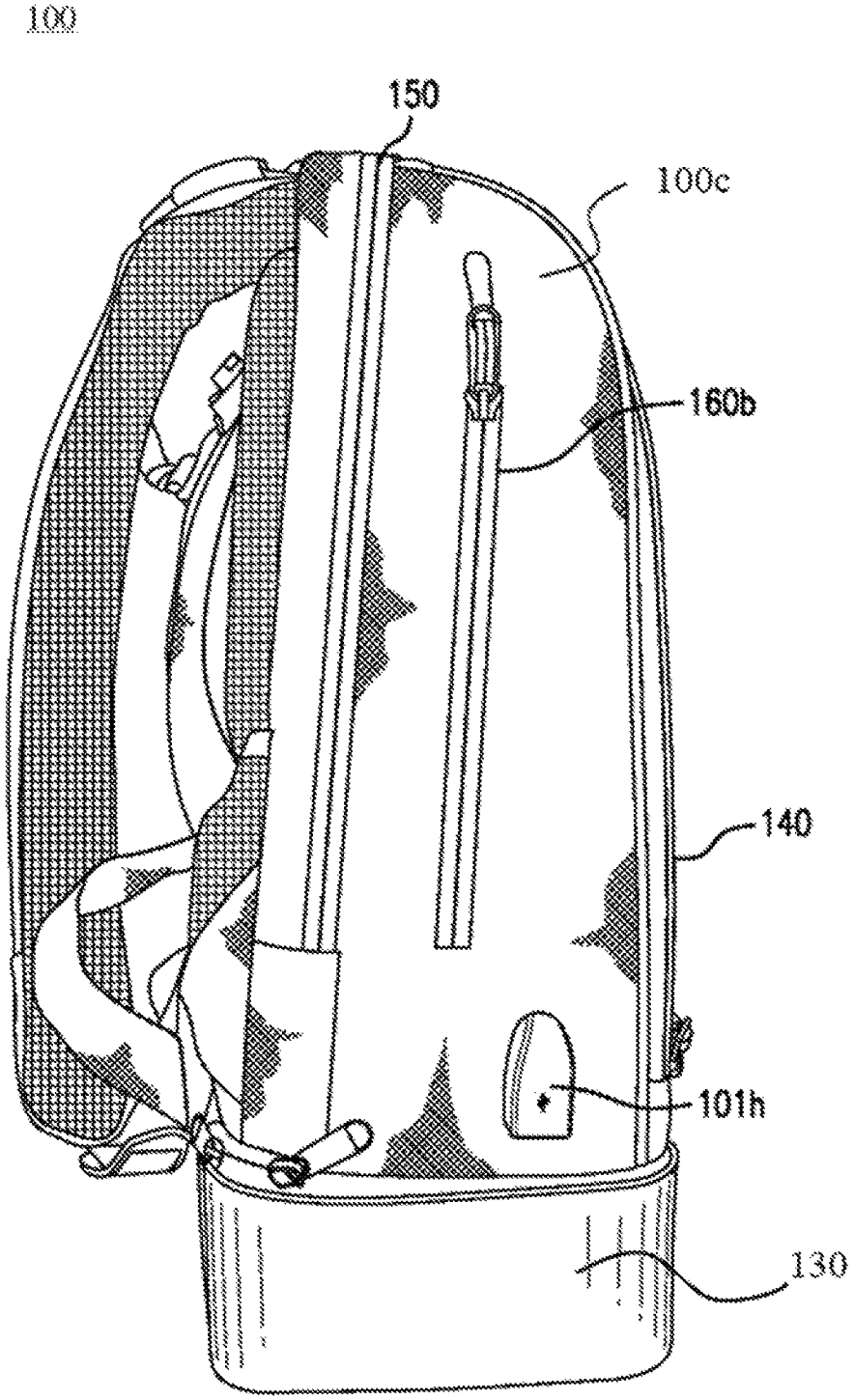
FIG. 3A is a side view of an exemplary backpack according to an embodiment of the present invention.
Figure 3B:
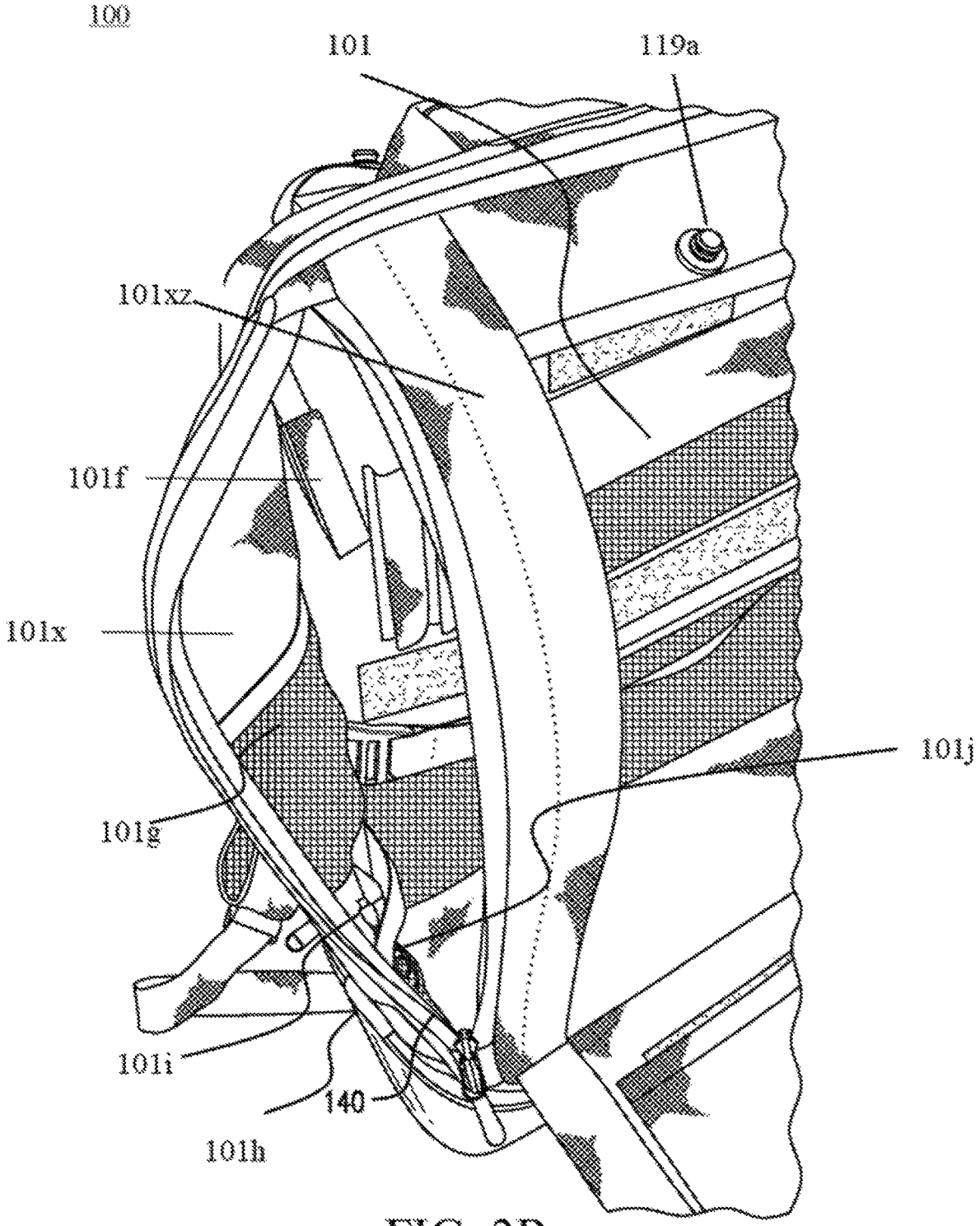
FIG. 3B is a close-up side perspective view of an exemplary backpack according to an embodiment of the present invention.

In an embodiment of the present invention, main internal compartment 101 can include storage designed to be accessed via side zipper 140. For example, lateral walls 101*x* of main internal compartment 101 can include a webbing loop 101*f* and/or one or more mesh pockets 101*g*. In a preferred embodiment, webbing loop 101*f* includes hook and loop type fasteners which enables webbing loop 101*f* to be opened and closed. For example, as shown in FIG. 3B, webbing loop 101*f* may be opened so as to engage a key fob and closed to secure the key fob. Backpack 100 can additionally include a USB port 101*h*, which can be affixed on a first side 100*c* or second side 100*d*. Backpack 100 can include an electrical cable 101*i* extending from USB port 101*h* to a mesh pocket 101*j* on lateral walls 101*x* of the main internal compartment 101. Mesh pocket 101*j* can be designed for the storage of a portable battery charge (not pictured). In operation, a user may place a portable battery charger in mesh pocket 101*j* and connect to electrical cable 101*i* so that the user may charge an electronic device on-the-go via USB port 101*h*.

Figure 8:
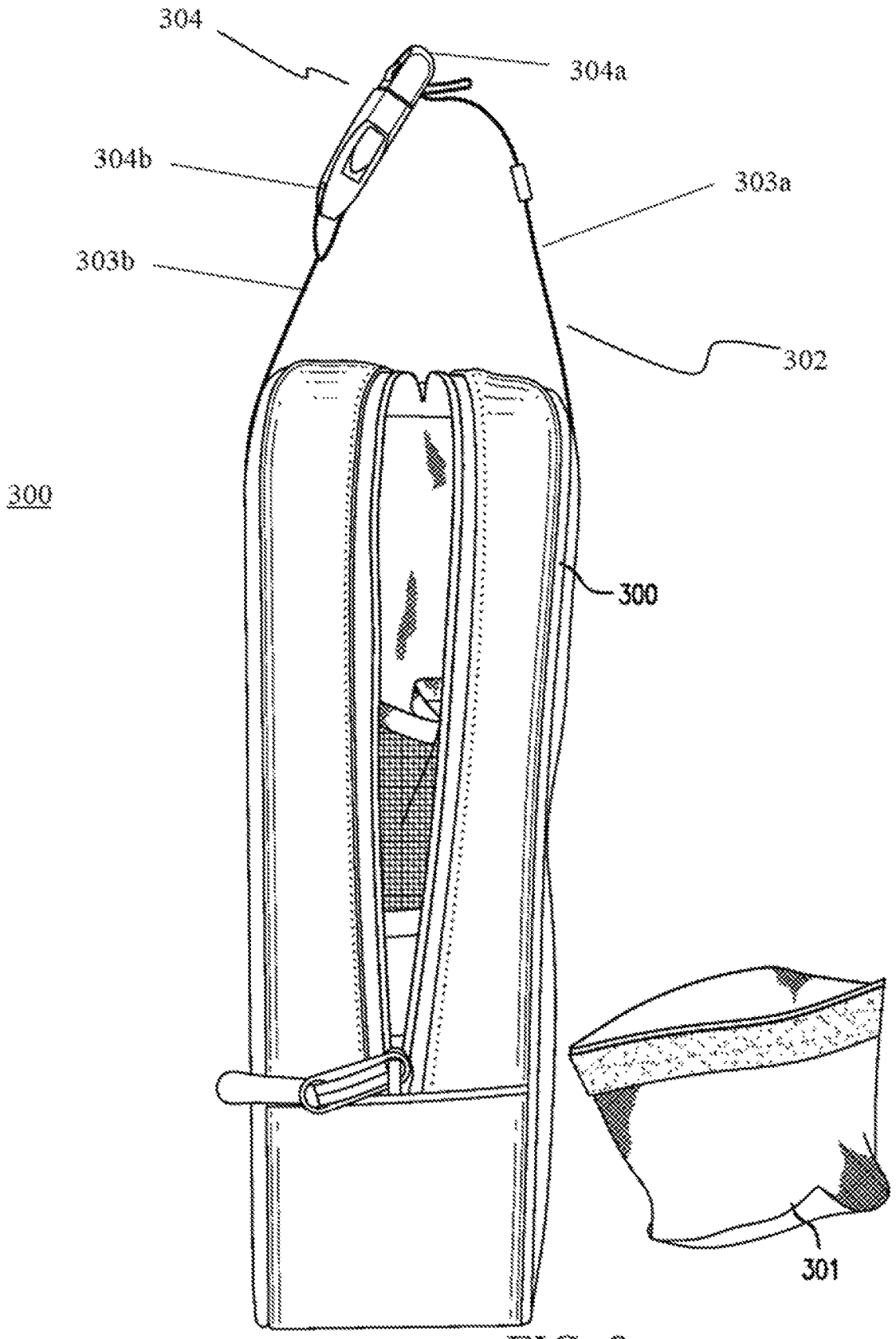
FIG. 8 is a front view of an exemplary beverage pack according to an embodiment of the present invention.

In an embodiment of the present invention, main internal compartment 101 can additionally include a removable beverage pack 300. Beverage pack 300 may be accessible through side zipper 140 and may be designed and dimensioned to store hot or cold beverage containers. For example, beverage pack 300 can be designed and dimensioned to store a standard size (i.e., 750 ml) wine bottle, baby bottle(s), or three or more baby food containers. As shown in FIG. 8, beverage pack 300 may be substantially insulated so as to substantially maintain the temperature of items stored in beverage pack 300. Beverage pack 300 can additionally include a removable liner 301, which may be removed for easy cleaning of accidental leaks. Removeable liner 301 can be washable and may be secured inside beverage pack 300 via fasteners such as, for example, hook and loop type fasteners, snaps, magnets, etc. Beverage pack 300 can include a hanging strap 302 designed and configured to allow the beverage pack 300 to be coupled or hanged to a stroller, a car seat, or another object. For example, hanging strap 302 can include one or more straps 303 having a first section 303*a* and a second section 303*b*. A first end of first section 303*a* and second section 303*b* can be coupled to the beverage pack 300. The second end of first section 303*a* can include a fastener 304*a* and second section 303*b* can include another fastener 304*b*. Fastener 304*a* can be removably coupled to fastener 304*b* such that, when coupled, first section 303*a* and second section 303*b* form a loop which can be used to hang beverage pack 300 from a stroller, car, or another structure. For example, beverage pack 300 can hang from another structure by having at least a portion of the structure pass through the loop.

As can be seen in FIG. 2, back side 100*b* of the body of the diaper backpack can comprise a plurality of padding 102*a* and a plurality of shoulder straps 103. Padding 102*a* can be designed and configured to provide ventilation and cushioning to the back of a user while the user carries backpack 100 on their back using the plurality of shoulder straps 103. Padding 102*a* can be designed and configured to provide a luggage pass-through 102*b*, such that backpack 100 may be secured to the handles of rolling carry-on luggage. Padding 102*a* may be additionally configured to conceal internal pocket 107 (not shown), which may be designed to store valuable items, and may further include a fastener such as a zipper.

Figure 11A:
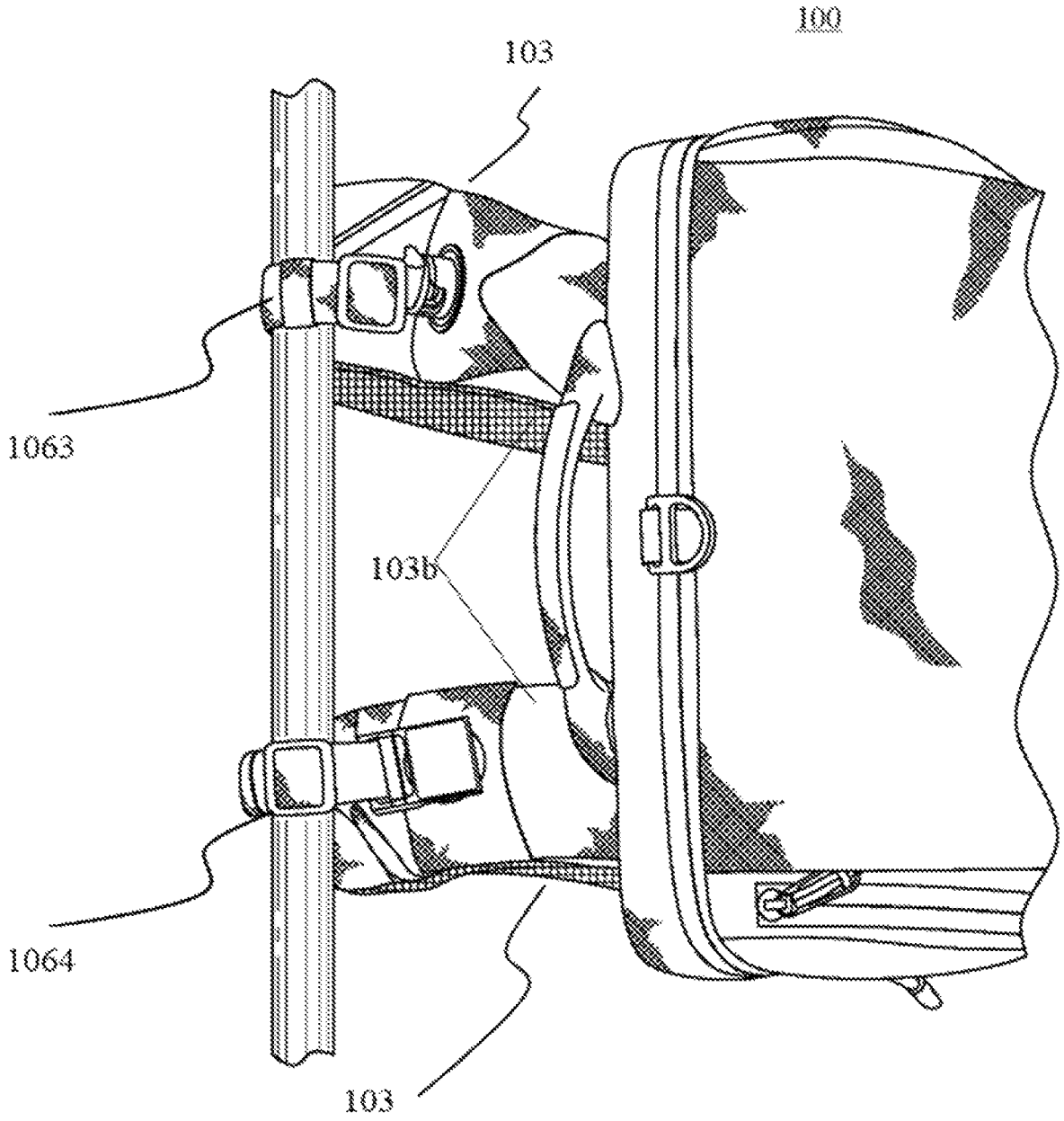
FIGS. 11A-C are back views of an exemplary backpack according to an embodiment of the present invention; and, FIG. 11D is a top view of an exemplary backpack according to an embodiment of the present invention.
Figure 11B:
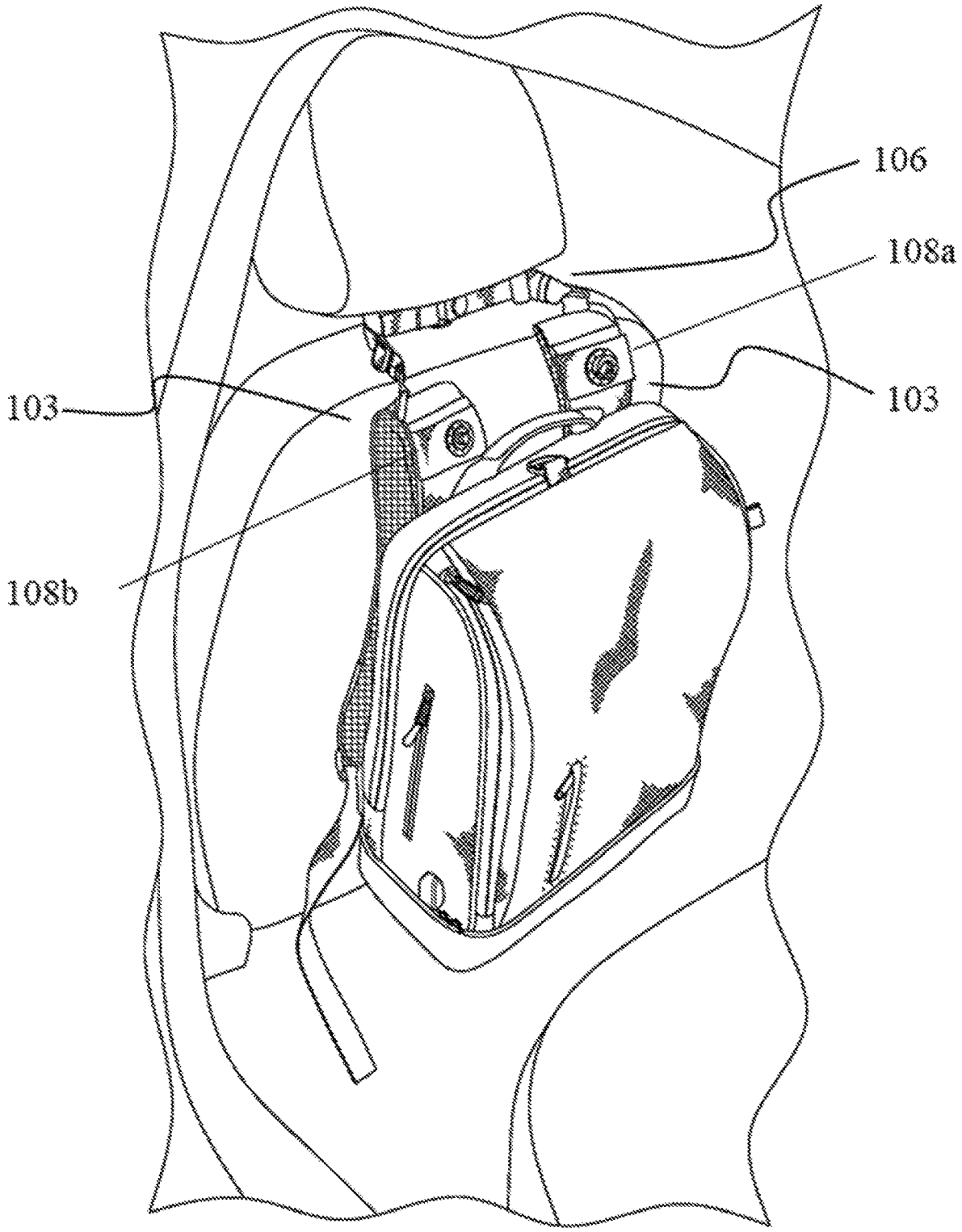
Figure 11C:
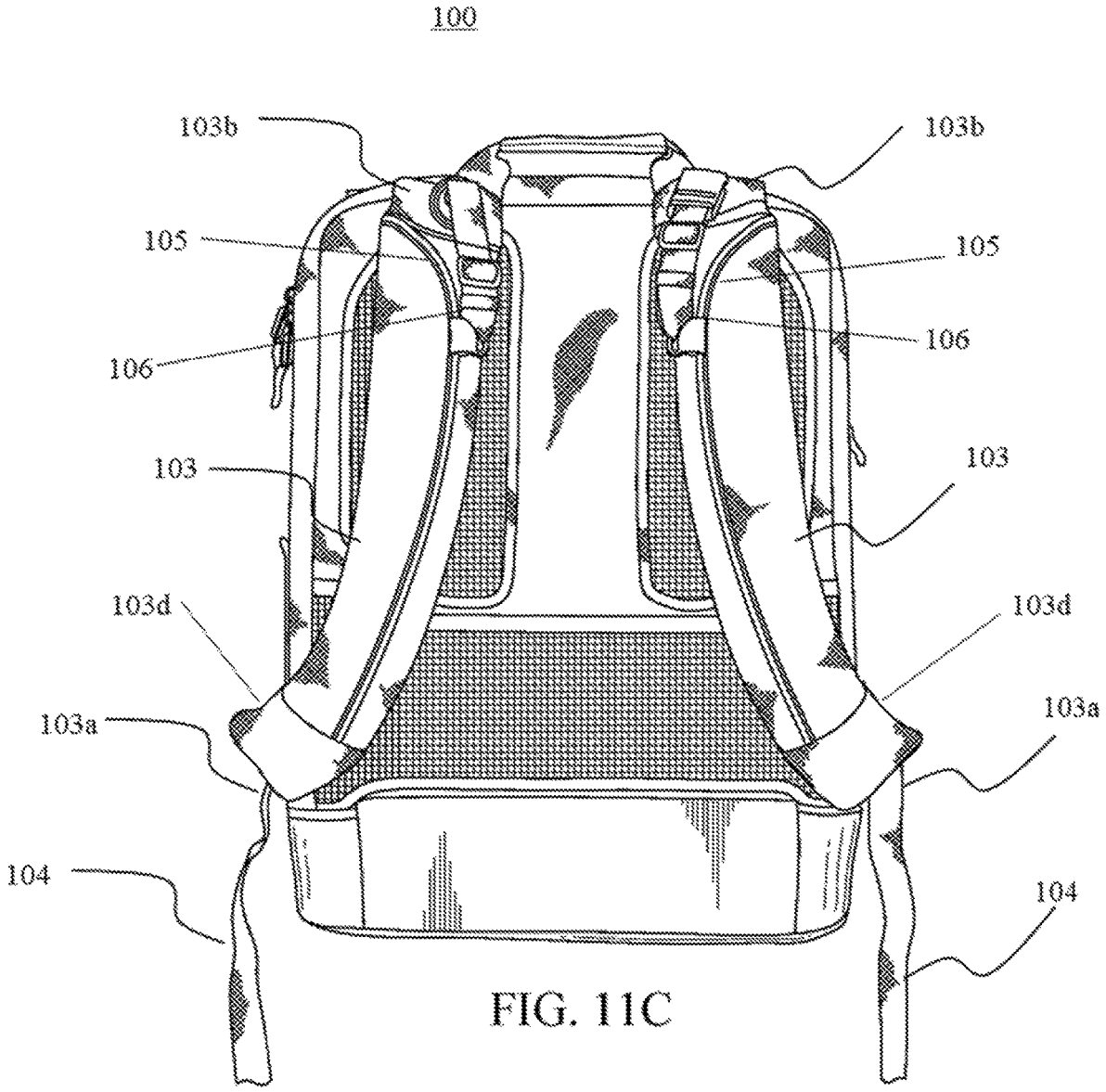
Figure 11D:
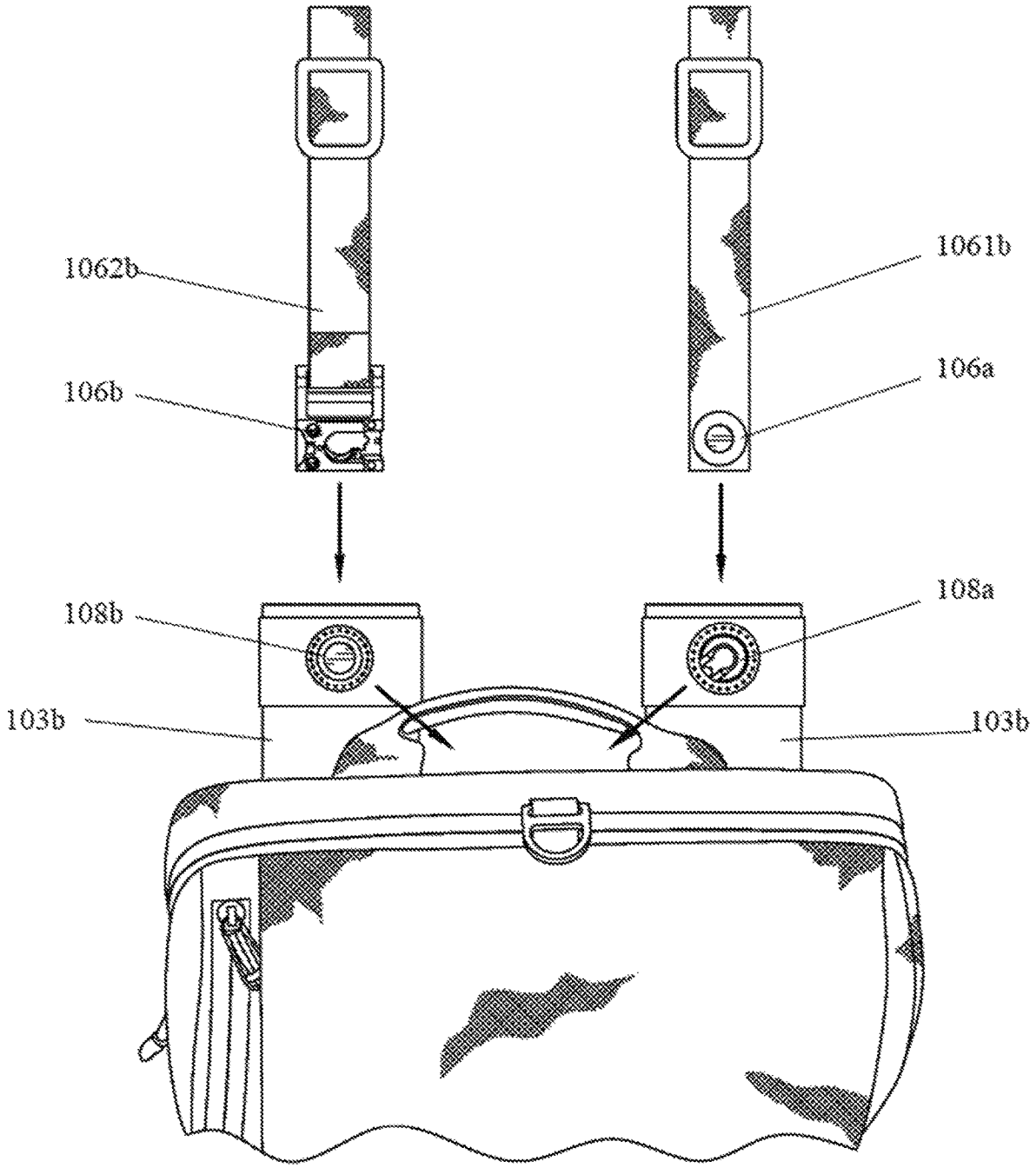

Plurality of shoulder straps 103 can be designed and configured to allow the diaper backpack to be carried on the back of the user or to be hanged from the frame of a stroller or car seat. As can be seen in FIG. 2, the user can strap the body of diaper backpack 100 to the torso of the user by positioning plurality of straps 103 around the upper torso of the body of the user. When the diaper of the baby needs to be changed, the user releases plurality of straps 103 and removes body 100*a* of the diaper backpack 100 from the body of the user. The plurality of shoulder straps 103 can comprise a body which is an elongated padded body with a first edge 103*a* and a second edge 103*b*. As can be seen in FIG. 2, first edge 103*a* of the body of the plurality of shoulder straps 103 can be attached to an adjustable strap 104 which can attach the body of the plurality of straps to the bottom corners of the bottom of diaper backpack 100. Second edge 103*b* of the body of the plurality of shoulder straps 103 can attach to the back edge of the top of diaper backpack 100. Adjustable strap 104 can include one or more adjusters which can allow the user to adjust the length of the plurality of shoulder straps 103. As can be seen in FIG. 2, a plurality of supports 105 can run along the length of the body of plurality of shoulder straps 103. In a preferred embodiment of the present invention, the plurality of supports can be one or more elongated, flexible rods 105 which can engage one or more straps 106. As can be seen in FIGS. 2 and 11A-D, the one or more straps 106 can form a securing loop, which may be used as a sternum strap and can provide additional support to the body of the user to more comfortably carry the diaper backpack. Furthermore, one or more strap 106 can be length adjustable. Each one of the one or more strap 106 can comprise a first section 1061 and a second section 1062 with a first end 1061*a* and 1062*a*, respectively, and a second end 1061*b* and 1062*b*, respectively. The first end 1061*a* of the first section 1061 and the first end 1062*a* of the second section 1062 can be coupled to the plurality of supports 105 and can be configured to be adjustably positioned at a variety of positions along the length of flexible rods 105. A user can then secure plurality of strap 103 at different positions along the length of plurality of supports 105 to carry diaper backpack 100 comfortably. For example, in an embodiment, supports 105 may include rigid tubes which function as rails and first end 1061*a* of the first section 1061 and the first end 1062*a* of the second section 1062 may include a mechanism to slidably couple to right tubes. The second end 1061*b* of the first section 1061 can include a fastener 106*a* and the second end 1062*b* of the second section 1062 can include a fastener 106*b*, and fasteners 106*a* and 106*b* can allow the user to removably couple the second end 1061*b* of the first section 1061 to the second end 1062*b* of the second section 1062 thereby forming a securing loop which may be used as a sternum strap 106, as shown in FIG. 2. Additionally, as shown in FIGS. 11A-C, securing loop can be used to secure backpack 100 to a stroller, a car seat, or other structures. For example, securing loop permits backpack 100 to be secured to a structure by having at least a portion of the structure pass through the securing loop. Fasteners 106*a* and 106*b* can be any type of closure mechanism, such as magnetic closures, side-release buckles, button closures, etc. In an embodiment, a user may disengage fastener 106*a* from fastener 106*b* by sliding fastener 106*a* relative to fastener 106*b*, or vice versa. As can be seen in FIGS. 2, 6 and 11A-D, shoulder straps 103 can additionally include fasteners 108*a* and 108*b* coupled to shoulder straps 103. Fasteners 108*a* and 108*b* can be of any type, such as magnetic closures, side-release buckles, button closures, etc., and can be configured to couple to fasteners 106*a* and 106*b*, respectively. For example, in use, as shown in FIGS. 11A and 11C, fastener 108*a* can be configured to couple to fastener 106*a* thereby forming a securing loop 1063, and fastener 108*b* can be configured to couple to fastener 106*b* thereby forming another securing loop 1064 such that the securing loops 1063 and 1064 can enable one or more shoulder strap 103 to secure or hang backpack 100 to the body of a stroller, car seat, or another structure. For example, securing loop 1063 and 1064 permit backpack 100 to be secured to a structure by having at least a portion of the structure pass through the securing loops 1063 and 1064. In an embodiment, as shown in FIG. 11C, a user may disengage fastener 106*a* from fastener 108*a* by sliding fastener 106*a* relative to fastener 108*b*, or vice versa. Similarly, a user may disengage fastener 106*b* from fastener 108*b* by sliding fastener 106*b* relative to fastener 108*b*, or vice versa. Advantageously, as shown in FIG. 11B, if changing the diaper of the baby inside a car, the securing loops 1063 and 1064 allow a user to secure or hang backpack 100 to the back of a car seat such that front flap 110 and pad 111 can be deployed on the back seat of car allowing a user to change a baby's diaper. In a preferred embodiment, fasteners 108*a* and 108*b* are magnetic closures and are removably coupled to the plurality of shoulder straps 103 towards second edge 103*b* using fasteners such as hook and loop type fasteners. In alternate embodiments of the present invention, shoulder straps 103 can have a different design and/or additional plurality of components. As shown in FIG. 2, shoulder straps 103 can further include one or more pockets 103*d* which can allow a user to store away the plurality of shoulder straps 103 when not in use. Additionally, pockets 103*d* may be designed and configured to act as a luggage pass-through and enable attachment of additional accessories, such as, for example, cell-phone clip or bag, baby carrier, etc.

Additionally, as shown in FIG. 3B, backpack 100 can include a side zipper 140 which can additionally provide access to lateral walls 101*x* of the main internal compartment 101 of backpack 100. Side zipper 140 can be any size and may run along the entire length of the main internal compartment 101 so as to enable easy and full access to lateral walls 101*x* or main internal compartment 101. Side zipper 140 can be located on either the right side or the left side of backpack 100.

Figure 9A:
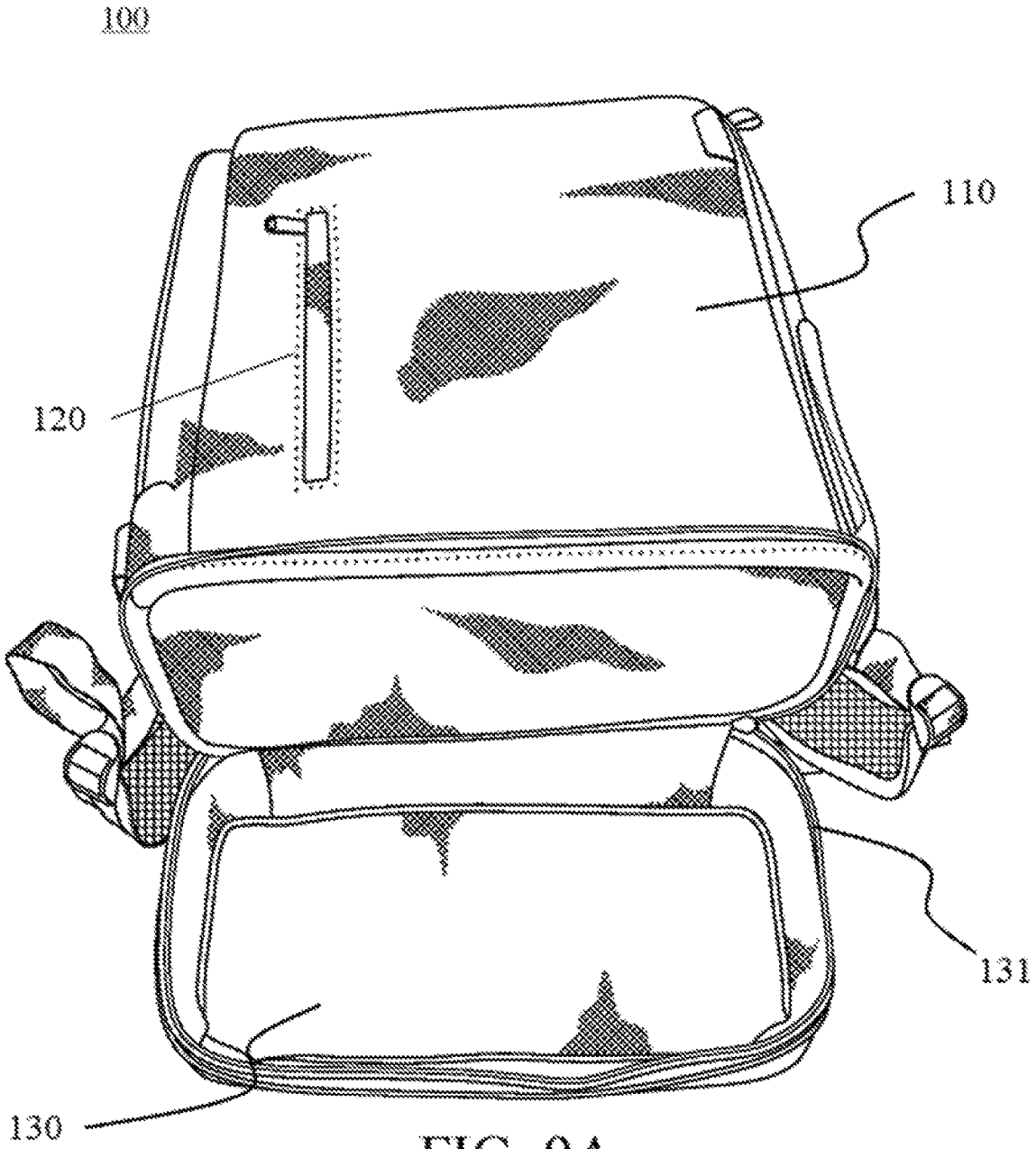
FIGS. 9A-B are views of an exemplary backpack according to an embodiment of the present invention.
Figure 9B:
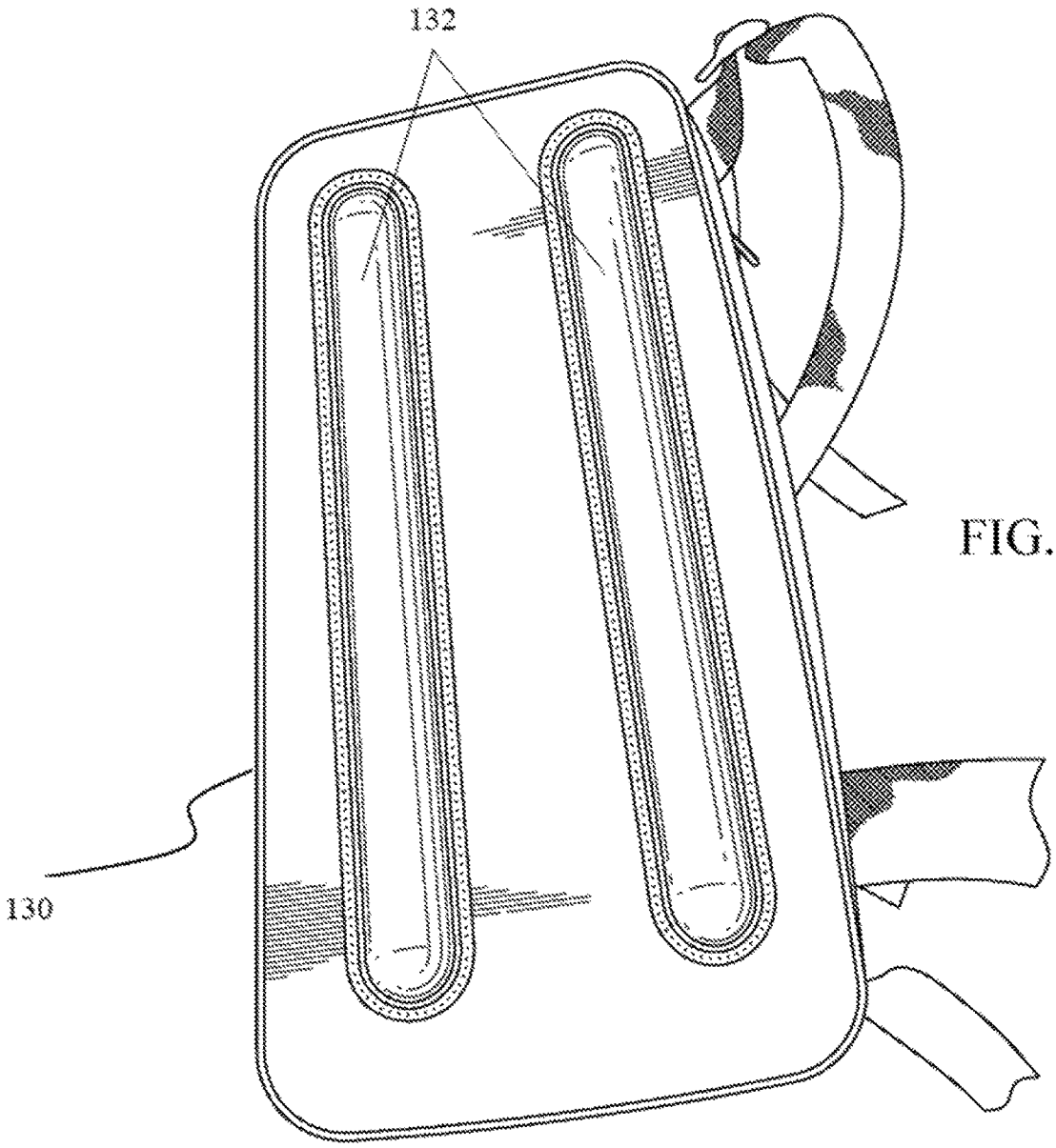

Further, as shown in FIG. 9A, backpack 100 can include a second internal compartment 130. Second internal compartment 130 may be located below main internal compartment 101 and accessed via a fastener 131 such as, for example, a zipper, snap-buttons, etc. Fastener 131 may be located along a portion of the perimeter of the second internal compartment 130. As shown in FIG. 9A, fastener 131 can extend along the majority of the perimeter of the second internal compartment 130 to allow greater accessibility and ease of access. In a preferred embodiment, second internal compartment 130 can encompass the entire bottom footprint of backpack 100. Second internal compartment 130 may be designed and configured to act as the base of backpack 100 and may additionally include support legs 132 configured to provide structural support to backpack 100. According to embodiments of the present invention, the plurality of support legs 132 may be connected to the bottom of second internal compartment 130. In another embodiment of the present invention, support legs 132 may be a frame connected to the base of backpack 100 which allows backpack 100 to maintain an upright position. This may be preferable, for example, when a user places backpack 100 on a surface to change a baby's diaper on pad 111. Maintaining the backpack 100 in an upright position would enable the user to easily and quickly access main internal compartment 101's contents while using pad 111. The frame may comprise a plurality of solid sections integrated inside the body of diaper backpack 100. In alternate embodiments of the present invention, the bottom of the body of diaper backpack 100 may further comprise an additional plurality of components. Support legs 132 may be located internally or externally on second internal compartment 130. In use, legs 132 provide sufficient support to allow a user to easily place backpack 100 on any surface and to keep backpack 100 in an upright position regardless of the content of backpack 100. Support legs 132 may be in the form of a plurality of rails. For example, legs 132 may include two, three, or more support railings.

Figure 10:
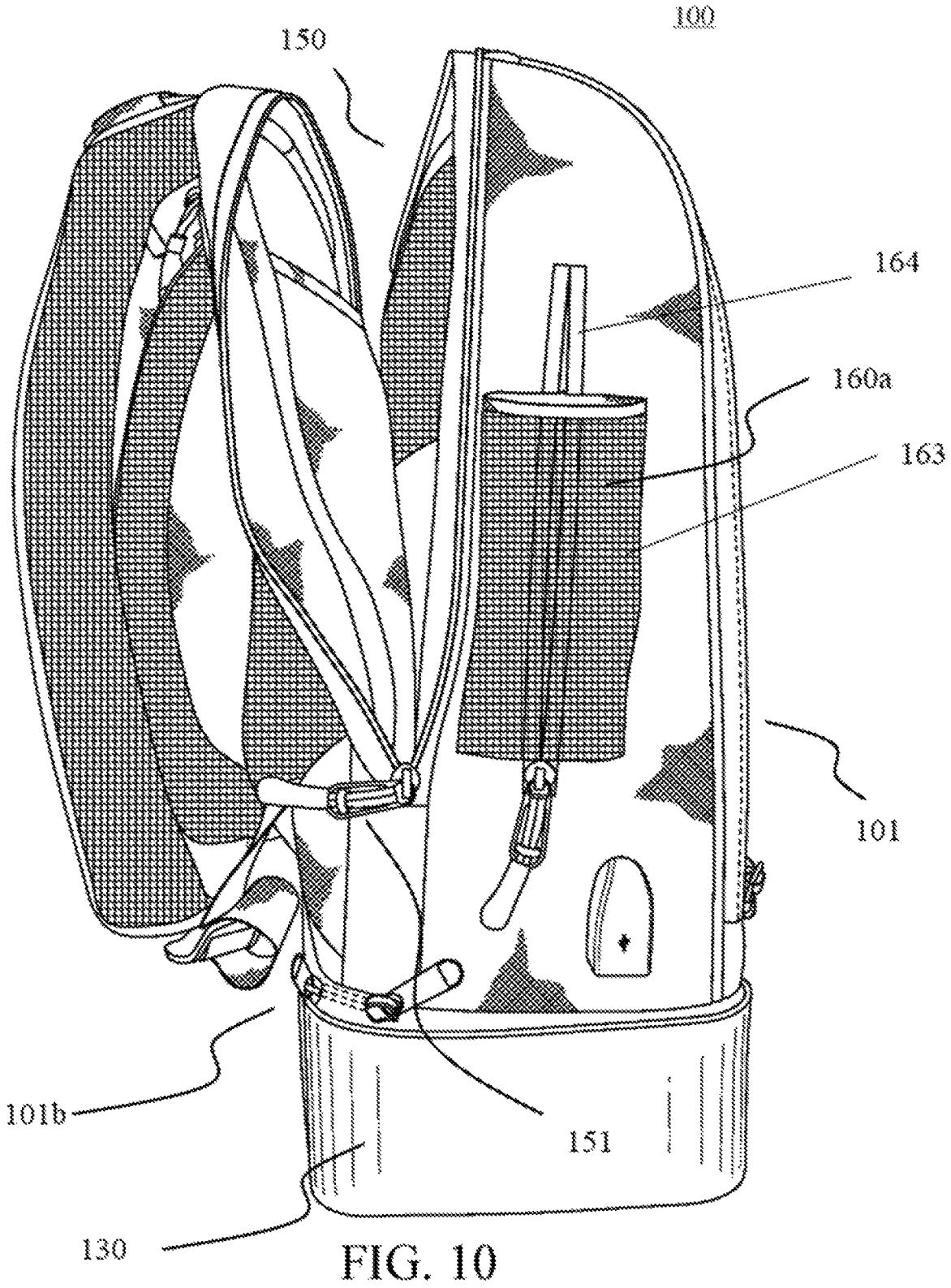
FIG. 10 is a side view of an exemplary backpack according to an embodiment of the present invention.

According to embodiments of the present invention, as shown in FIG. 10, backpack 100 can include a third internal compartment 150. Third internal compartment 150 can be located along the back of main internal compartment 101 and on the back side 101*b* of backpack 100. Third internal compartment 150 can include internal padding to provide a compartment for storage of sensitive or high-value equipment, such as, for example, cell phones, laptops, tablets, other electronic devices, etc. Third internal compartment 150 can be accessed via a fastener 151 such as, for example, a zipper, snap-buttons, etc. Fastener 151 can be located along a portion of the perimeter of the third internal compartment 150. In a preferred embodiment, as shown in FIG. 10, fastener 151 can extend along the majority of the perimeter of second internal compartment 150 to allow greater accessibility to second internal compartment 150.

Figure 4:
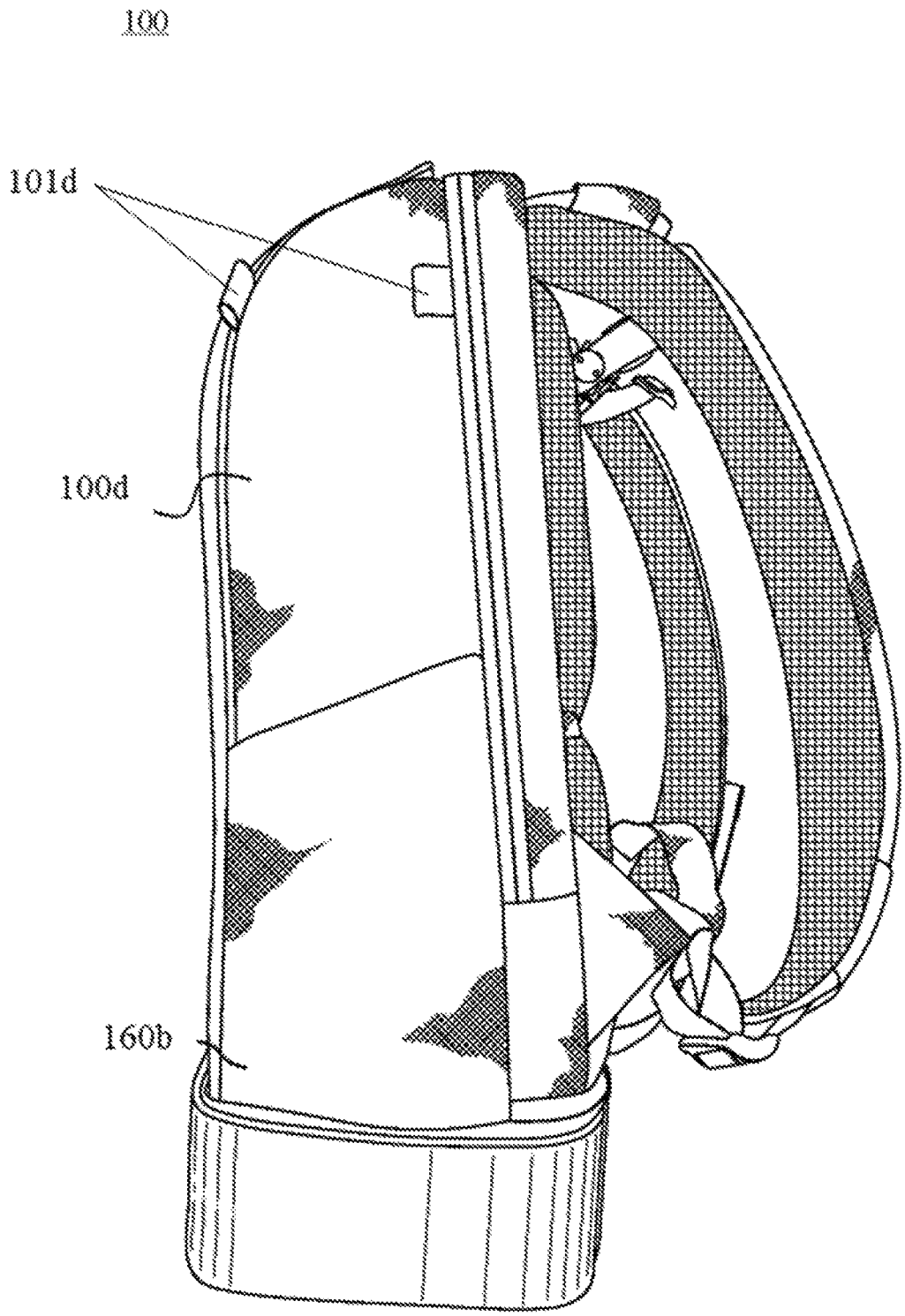
FIG. 4 is a side view of an exemplary backpack according to an embodiment of the present invention.

According to embodiments of the present invention, backpack 100 can include one or more beverage holders 160 designed and configured to hold beverage containers such as travel mugs, bottles, etc. Beverage holders 160 may be located on the sides of backpack 100 and may be designed to be hidden when not in use. For example, backpack 100 may include a first beverage holder 160*a* on the first side 100*c* of backpack 100 and a second beverage holder 160*b* on the second side 100*d* of backpack 100. In an embodiment, as shown in FIG. 4, beverage holder 160*b* may include fabric flap 161 (not shown) and mesh 162 (not shown). When beverage holder 160*b* is not in use, fabric flap 161 may be folded flush against the side of the backpack 100 thereby concealing mesh 162. Further, fabric flap 161 may be coupled to backpack 160 using fasteners, such as hook and loop type fasteners, magnetic fasteners, etc. In another embodiment, shown in FIG. 10, beverage holder 160*a* may include a mesh 163. When beverage holder 160*a* is not in use, mesh 163 may be folded and tucked inside side inner pocket 164. Inner pocket 164 may be sealed using fasteners, such as zippers.

According to embodiments of the present invention, backpack 100 can include webbing loops 103*a* on the first side 100*c* or second side 100*d*. As shown in FIG. 4, webbing loops may be located on second side 100*d* and may be designed to receive hooks 101*d* affixed to compression strap 101*e*. Compression strap 101*e* may be used to secure storage items to second side 100*d* to allow additional storage capacity for storage of a variety of items, such as, for example, camera tripods.

The embodiments and examples shown above are illustrative, and many variations can be introduced to them without departing from the spirit of the disclosure or from the scope of the appended claims. For example, elements and/or features of different illustrative and exemplary embodiments herein may be combined with each other and/or substituted with each other within the scope of the disclosure. For a better understanding of the disclosure, reference should be had to the accompanying drawings and descriptive matter in which there is illustrated exemplary embodiments of the present invention.

The invention claimed is:

1. A bag comprising:

a first lateral wall including at least one magnetic fastener disposed along a first peripheral front edge; a second lateral wall including at least one further magnetic fastener disposed along a second peripheral front edge; and a front flap pivotably movable between a closed position and an open position and having at least one third magnetic fastener disposed along at least a portion of a perimeter of the front flap, the at least one third magnetic fastener releasably engaging the at least one magnetic fastener and the at least one further magnetic fastener when the front flap is in a closed position.

2. The bag of claim 1, wherein the front flap is designed and dimensioned to constitute substantially an entire front portion of the bag such that an internal compartment defined by the first and second lateral walls is substantially entirely accessible when the front flap is in the open position.

3. The bag of claim 1, further comprising a back wall including a top fastener disposed along a peripheral top edge extending from the back wall, and a second top fastener disposed along a top portion of the perimeter of the front flap, the second top fastener releasably engaging the top fastener when the front flap is in a closed position.

4. The bag of claim 3, wherein the second top fastener disengages the top fastener upon the application of a first force and a second force, a direction of the first force and a direction of the second force disposed in separate planes.

5. The bag of claim 1, further comprising a foldable diaper pad removably coupled to an interior surface of the front flap.

6. The bag of claim 5, wherein the diaper pad is removably coupled to a track attached to the interior surface of the front flap, the track including a loop that slidably engages a second loop disposed on the diaper pad.

7. The bag of claim 1, further comprising support structures configured to enable the bag to stay upright when placed on a surface.

8. The bag of claim 1, wherein, in the closed position, the releasable engagement of the at least one third magnetic fastener with the at least one magnetic fastener and the at least one further magnetic fastener substantially seals the front flap and the first and second peripheral edges of the first and second lateral walls.

9. The bag of claim 1, further comprising a beverage pack having a profile configured to be removably stored within the bag.

10. The bag of claim 1, further comprising:

a multi-function strap including a first member and a second member, a first end of the first member movably coupled to a first shoulder strap and a second end of the first member having a first strap fastener disposed thereon and a first end of the second member movably coupled to a second shoulder strap and a second end of the second member having a second strap fastener disposed thereon, the first and second strap fasteners being couplable to each other and couplable to third and fourth strap fasteners disposed on the first and second shoulder straps, respectively.

11. The bag of claim 10, wherein the first strap fastener couples to the third strap fastener to form a securing loop and the second strap fastener couples to the fourth strap fastener to form a further securing loop, the securing loop and the further securing loop permitting the bag to be secured to a structure by having at least a portion of the structure pass through the securing loop and the further securing loop.

12. The bag of claim 10, wherein the first strap fastener couples to the second strap fastener to form a third securing loop, the third securing loop permitting the bag to be secured to a structure by having at least a portion of the structure pass through the third securing loop.

13. A bag comprising:

a first lateral wall including at least one fastener disposed along a first peripheral front edge; a second lateral wall including at least one further fastener disposed along a second peripheral front edge;

a front flap pivotably movable between a closed position and an open position and having at least one third fastener disposed along at least a portion of a perimeter of the front flap, the at least one third fastener releasably engaging the at least one fastener and the at least one further fastener when the front flap is in a closed position; and a foldable diaper pad removably coupled to a track attached to an interior surface of the front flap, the track including a loop that slidably engages a second loop disposed on the diaper pad.

14. The bag of claim 13, further comprising a foldable diaper pad removably coupled to an interior surface of the front flap.

15. The bag of claim 13, wherein the front flap is designed and dimensioned to constitute substantially an entire front portion of the bag such that an internal compartment defined by the first and second lateral walls is substantially entirely accessible when the front flap is in the open position.

16. The bag of claim 13, further comprising a back wall including a top fastener disposed along a peripheral top edge extending from the back wall, and a second top fastener disposed along a top portion of the perimeter of the front flap, the second top fastener releasably engaging the top fastener when the front flap is in a closed position.

17. A bag comprising:

a first lateral wall including at least one fastener disposed along a first peripheral front edge; a second lateral wall including at least one further fastener disposed along a second peripheral front edge;

a front flap pivotably movable between a closed position and an open position and having at least one third fastener disposed along at least a portion of a perimeter of the front flap, the at least one third fastener releasably engaging the at least one fastener and the at least one further fastener when the front flap is in a closed position; and a multi-function strap including a first member and a second member, a first end of the first member movably coupled to a first shoulder strap and a second end of the first member having a first strap fastener disposed thereon and a first end of the second member movably coupled to a second shoulder strap and a second end of the second member having a second strap fastener disposed thereon, the first and second strap fasteners being couplable to each other and couplable to third and fourth strap fasteners disposed on the first and second shoulder straps, respectively.

18. The bag of claim 17, further comprising a foldable diaper pad removably coupled to an interior surface of the front flap.

19. The bag of claim 17, wherein the front flap is designed and dimensioned to constitute substantially an entire front portion of the bag such that an internal compartment defined by the first and second lateral walls is substantially entirely accessible when the front flap is in the open position.

20. The bag of claim 17, further comprising a back wall including a top fastener disposed along a peripheral top edge extending from the back wall, and a second top fastener disposed along a top portion of the perimeter of the front flap, the second top fastener releasably engaging the top fastener when the front flap is in a closed position.

* * * * *